US010409196B2

(12) United States Patent
Koike et al.

(10) Patent No.: US 10,409,196 B2
(45) Date of Patent: Sep. 10, 2019

(54) IMAGE FORMING APPARATUS INCLUDING DEVELOPING DEVICES, DEVELOPING CONTAINERS, AND CHANGEABLE CONVEYANCE PATHS BETWEEN THE DEVELOPING DEVICES AND THE DEVELOPING CONTAINERS

(71) Applicant: Ricoh Company, Ltd., Tokyo (JP)

(72) Inventors: Toshio Koike, Tokyo (JP); Jun Shiori, Kanagawa (JP); Teppei Kikuchi, Kanagawa (JP); Michiharu Suzuki, Kanagawa (JP); Kazuhiro Aso, Kanagawa (JP); Keinosuke Kondoh, Kanagawa (JP); Tadashi Ogawa, Tokyo (JP); Hideo Yoshizawa, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 15/976,057

(22) Filed: May 10, 2018

(65) Prior Publication Data

US 2018/0335721 A1 Nov. 22, 2018

(30) Foreign Application Priority Data

May 22, 2017 (JP) ..... 2017-101228

(51) Int. Cl.
*G03G 15/01* (2006.01)
*G03G 15/08* (2006.01)
*G03G 15/00* (2006.01)

(52) U.S. Cl.
CPC ..... *G03G 15/0879* (2013.01); *G03G 15/0121* (2013.01); *G03G 15/0126* (2013.01);
(Continued)

(58) Field of Classification Search
CPC ..... G03G 15/0891; G03G 15/0121; G03G 15/0126; G03G 15/0184; G03G 15/0879;
(Continued)

(56) References Cited

U.S. PATENT DOCUMENTS 7,515,855 B2 * 4/2009 Katsuyama ..... G03G 15/0874 399/258
9,239,542 B2 * 1/2016 Kasai ..... G03G 15/0863
(Continued)

FOREIGN PATENT DOCUMENTS

JP 5-035042 2/1993
JP 2001092212 A * 4/2001
(Continued)

OTHER PUBLICATIONS

Extended European Search Report dated Aug. 20, 2018 in Patent Application No. 18173274.4, 10 pages.

*Primary Examiner* — Robert B Beatty
(74) *Attorney, Agent, or Firm* — Xsensus LLP

(57) ABSTRACT

An image forming apparatus includes an intermediate transferor to rotate in a predetermined rotation direction, a plurality of image bearers disposed along the intermediate transferor to bear latent images, a plurality of developing devices to develop the latent images, a plurality of developer containers to contain developers, and a plurality of conveyance paths each corresponding to a respective one of the plurality of developing devices and a respective one of the plurality of developer containers to supply the developers to the plurality of developing devices respectively. An arrangement of the plurality of developing devices in the predetermined rotation direction is configured to be changed without changing an arrangement of the plurality of developer containers. A layout of the plurality of conveyance paths is configured to be changed without changing connections
(Continued)

between a supply source and a supply destination of the plurality of conveyance paths.

13 Claims, 14 Drawing Sheets

(52) U.S. Cl.
CPC ..... *G03G 15/0189* (2013.01); *G03G 15/6585* (2013.01); *G03G 2221/1603* (2013.01); *G03G 2221/1815* (2013.01)

(58) Field of Classification Search
CPC ..... G03G 15/6585; G03G 21/1676; G03G 2215/0119; G03G 2221/1603; G03G 15/0189
USPC ..... 399/223
See application file for complete search history.

(56) References Cited

U.S. PATENT DOCUMENTS

| | | | | |
|---|---|---|---|---|
| 2007/0231011 | A1* | 10/2007 | Nose | G03G 15/0879 399/227 |
| 2011/0064475 | A1* | 3/2011 | Yoshida | G03G 15/0126 399/258 |
| 2011/0243591 | A1* | 10/2011 | Tanimura | B41J 2/2114 399/54 |
| 2013/0195509 | A1* | 8/2013 | Takahashi | G03G 15/0879 399/258 |
| 2014/0248061 | A1 | 9/2014 | Takami et al. | |
| 2015/0037049 | A1 | 2/2015 | Shiraishi et al. | |
| 2015/0078788 | A1 | 3/2015 | Koike et al. | |
| 2015/0139671 | A1 | 5/2015 | Matsumoto et al. | |
| 2015/0227086 | A1 | 8/2015 | Kondoh et al. | |
| 2015/0248107 | A1 | 9/2015 | Hamada et al. | |
| 2015/0261134 | A1 | 9/2015 | Kikuchi et al. | |
| 2015/0323884 | A1 | 11/2015 | Kikuchi et al. | |
| 2015/0338824 | A1 | 11/2015 | Shimizu et al. | |
| 2015/0346635 | A1 | 12/2015 | Nodera et al. | |
| 2016/0026113 | A1 | 1/2016 | Takahashi et al. | |
| 2016/0054691 | A1 | 2/2016 | Hase et al. | |
| 2016/0070208 | A1 | 3/2016 | Kikuchi et al. | |
| 2016/0170329 | A1 | 6/2016 | Kimura et al. | |
| 2016/0195846 | A1 | 7/2016 | Koshizuka et al. | |
| 2016/0202630 | A1 | 7/2016 | Okamoto et al. | |
| 2016/0202660 | A1 | 7/2016 | Terai et al. | |
| 2016/0223946 | A1 | 8/2016 | Kikuchi et al. | |
| 2016/0306300 | A1 | 10/2016 | Hamada et al. | |
| 2016/0306318 | A1 | 10/2016 | Tomita et al. | |
| 2016/0342134 | A1 | 11/2016 | Shiori et al. | |
| 2017/0248871 | A1 | 8/2017 | Iwatsuki et al. | |
| 2018/0321615 | A1* | 11/2018 | Suzuki | G03G 15/0189 |

FOREIGN PATENT DOCUMENTS

| | | | |
|---|---|---|---|
| JP | 2005003951 | A * | 1/2005 |
| JP | 2006-301495 | | 11/2006 |
| JP | 2011-150207 | | 8/2011 |
| JP | 2012-022141 | | 2/2012 |
| JP | 2012022141 | A * | 2/2012 |
| JP | 2014-170052 | | 9/2014 |
| JP | 2015-084087 | | 4/2015 |
| JP | 2016-031469 | | 3/2016 |
| JP | 2016-090688 | | 5/2016 |
| JP | 2017-21541 | A | 12/2017 |

* cited by examiner

IMAGE FORMING APPARATUS INCLUDING DEVELOPING DEVICES, DEVELOPING CONTAINERS, AND CHANGEABLE CONVEYANCE PATHS BETWEEN THE DEVELOPING DEVICES AND THE DEVELOPING CONTAINERS

CROSS-REFERENCE TO RELATED APPLICATION

This patent application is based on and claims priority pursuant to 35 U.S.C. § 119(a) to Japanese Patent Application No. 2017-101228, filed on May 22, 2017, in the Japan Patent Office, the entire disclosure of which is hereby incorporated by reference herein.

BACKGROUND

Technical Field

This disclosure generally relates to an image forming apparatus such as a copier, a facsimile machine, a printer, or a multifunction peripheral (MFP) having at least two of copying, printing, facsimile transmission, plotting, and scanning capabilities.

Related Art

Among image forming apparatuses, such as copiers, printers, facsimile machines, or MFPs, there are image forming apparatuses that include four image forming units for toner images in the colors yellow, magenta, cyan, and black to form normal color images and that additionally include an image forming unit for a special color such as white or clear.

SUMMARY

According to an embodiment of this disclosure, an improved image forming apparatus includes an intermediate transferor to rotate in a predetermined rotation direction, a plurality of image bearers disposed along the intermediate transferor in the predetermined rotation direction of the intermediate transferor to bear latent images, a plurality of developing devices to develop the latent images on the plurality of image bearers, a plurality of developer containers to contain developers, and a plurality of conveyance paths each corresponding to a respective one of the plurality of developing devices and a respective one of the plurality of developer containers to supply the developers contained in the plurality of developer containers to the plurality of developing devices respectively. An arrangement of the plurality of developing devices in the predetermined rotation direction is configured to be changed without changing an arrangement of the plurality of developer containers. In addition, a layout of the plurality of conveyance paths is configured to be changed without changing connections between a supply source and a supply destination of the plurality of conveyance paths.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
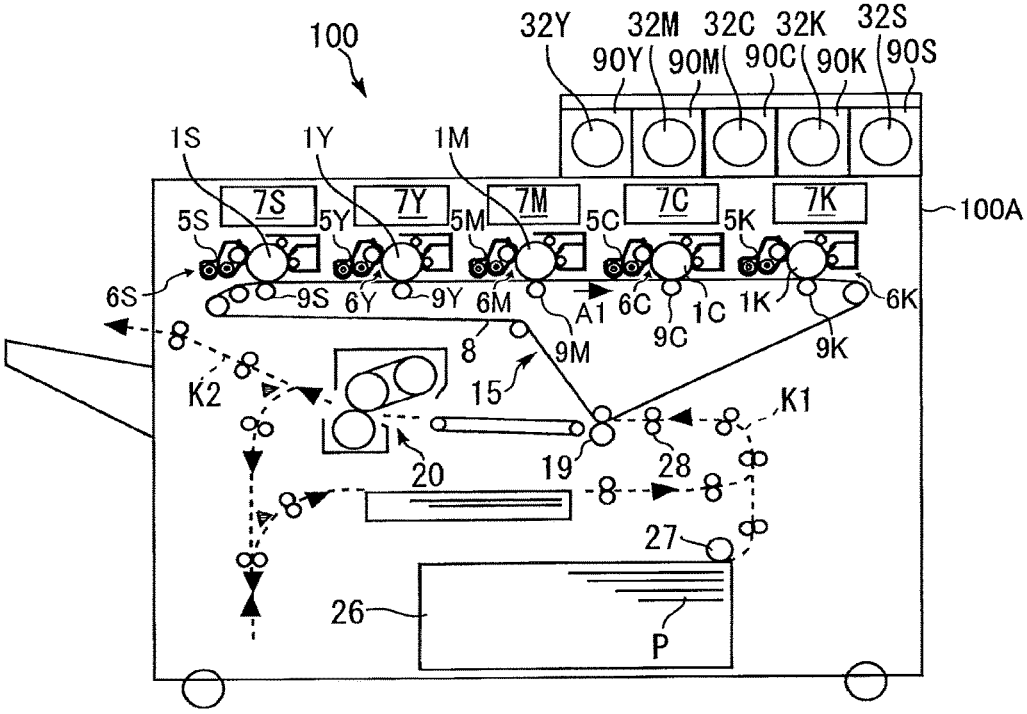
FIG. 1 is a schematic view of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted. In addition, identical or similar reference numerals designate identical or similar components throughout the several views.

DETAILED DESCRIPTION

In describing embodiments illustrated in the drawings, specific terminology is employed for the sake of clarity. However, the disclosure of this patent specification is not intended to be limited to the specific terminology so selected, and it is to be understood that each specific element includes all technical equivalents that have the same function, operate in a similar manner, and achieve a similar result.

As used herein, the singular forms "a", "an", and "the" are intended to include the plural forms as well, unless the context clearly indicates otherwise.

It is to be noted that the suffixes Y, M, C, K, and S attached to each reference numeral indicate only that components indicated thereby are used for forming yellow, magenta, cyan, black, and special color images, respectively, and hereinafter may be omitted when color discrimination is not necessary.

Embodiments according to the present disclosure are described in detail with reference to drawings. It is to be understood that an identical or similar reference character is given to identical or corresponding parts throughout the drawings, and redundant descriptions are omitted or simplified below.

A detailed description is provided below of an aspect according to a first embodiment referring to FIGS. 1 through 12.

Figure 2:
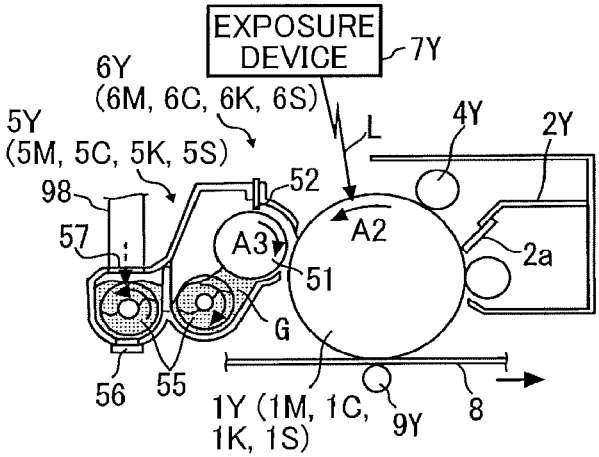
FIG. 2 is a cross-sectional view of a process cartridge of the image forming apparatus illustrated in FIG. 1.

Referring to FIGS. 1 and 2, a configuration and operation of an image forming apparatus 100 according to the present embodiment are described below.

FIG. 1 is a schematic view of the image forming apparatus 100, which in the present embodiment is a printer, for example. FIG. 2 is an enlarged view of a process cartridge 6Y of the image forming apparatus 100 illustrated in FIG. 1. As illustrated in FIG. 1, toner supply devices 90Y, 90M, 90C, 90K, and 90S (i.e., developer supply devices) are disposed on one end side above an apparatus body 100A of the image forming apparatus 100.

In the toner supply devices 90Y, 90M, 90C, 90K, and 90S, a toner container 32Y for yellow, a toner container 32M for magenta, a toner container 32C for cyan, a toner container 32K for black, and a toner container 32S for special color are respectively removably installed. The toner containers 32Y, 32M, 32C, 32K and 32S serve as developer containers and are substantially cylindrical in the present embodiment. Specifically, as illustrated in FIG. 1, the toner containers 32Y, 32M, 32C (and the toner supply devices 90Y, 90M, and 90C) corresponding to three colors (yellow, magenta, and cyan) are disposed in this order from the left. A toner container 32K (and the toner supply device 90K) for black is disposed to the right of the toner containers for three colors, with a toner container 32S (and toner supply device 90S) for special color is disposed on the far right, to the right of the toner container 32K.

In particular, the toner container 32S for the special color is often replaced with a toner container 32S for another type of special color depending on usage before all of the toner contained therein is consumed. Accordingly, the toner container 32S is replaced more frequently than the other toner containers 32Y, 32M, 32C, and 32K are, and for this reason, is disposed farthest to the right to facilitate replacement.

In the present embodiment, an arrangement order of the toner containers 32Y, 32M, 32C, 32K, and 32S and an upstream portion of the toner supply devices 90Y, 90M, 90C, 90K, and 90S are invariable.

Figure 5A:
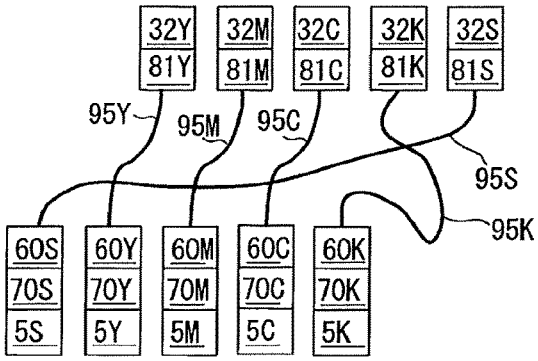
FIG. 5A is a block diagram illustrating an arrangement of components of the image forming apparatus illustrated in FIG. 1 when toner images are primarily transferred in the order of special color, color, and black from the upstream side in a rotation direction of an intermediate transfer belt in the image forming apparatus illustrated in FIG. 1.
Figure 5B:
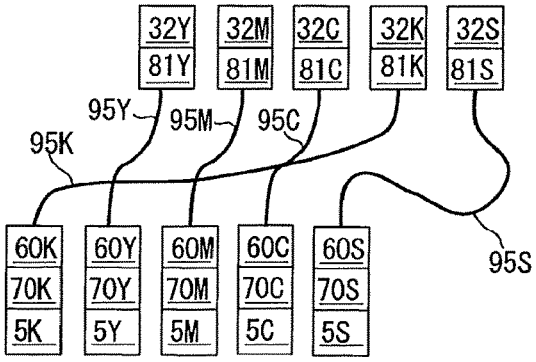
FIG. 5B is a block diagram illustrating the arrangement of components of the image forming apparatus illustrated in FIG. 1 when toner images are primarily transferred in the order of black, color, and special color from the upstream side in the rotation direction of the intermediate transfer belt in the image forming apparatus illustrated in FIG. 1.

Referring to FIGS. 1, 5A, and 5B, it can be seen that the toner supply device 90K for black supplies black toner (developer) contained in the toner container 32K (developer container) for black to a developing device 5K for black.

In addition, the three toner supply devices 90Y, 90M, and 90C for yellow, magenta, and cyan supply color toners of yellow, magenta, and cyan (developers) contained in toner containers 32Y, 32M, and 32C (developer containers) for colors to developing devices 5Y, 5M, and 5C for colors, respectively.

Furthermore, the toner supply device 90S for special color supplies special color toner (developer) contained in the toner container 32S (developer container) for special color to a developing device 5S for special color.

Any known toner can be used as the black toner; the color toner of each of yellow, magenta, and cyan; or the special color toner.

In particular, the special color toner is different from the black toner and the color toner, and known clear toner (transparent toner, colorless toner, achromatic toner, no-pigment toner, or the like), white toner, or the like can be used.

Referring to FIG. 1, five exposure devices 7Y, 7M, 7C, 7K, and 7S are disposed in an upper section of the apparatus body 100A, and process cartridges 6Y, 6M, 6C, 6K, and 6S, including the developing devices 5Y, 5M, 5C, 5K, and 5S, corresponding to yellow, magenta, cyan, black, and special color are disposed side by side therebelow, facing an intermediate transfer device 15 including an intermediate transfer belt 8.

As illustrated in FIG. 1, in the basic arrangement, the five process cartridges 6Y, 6M, 6C, 6K, and 6S, including the developing devices 5Y, 5M, 5C, 5K, and 5S, are disposed in the order of the process cartridge 6S (developing device 5S) for special color, the process cartridge 6Y (developing device 5Y) for yellow, the process cartridge 6M (developing device 5M) for magenta, the process cartridge 6C (developing device 5C) for cyan, and the process cartridge 6K (developing device 5K) for black from upstream in the direction of rotation of the intermediate transfer belt 8 (hereinafter, referred to as rotation direction). However, the arrangement order (arrangement) is appropriately variable according to usage.

Referring to FIGS. 5A and 5B, it can be seen that, in the present embodiment, the process cartridge 6K (developing device 5K) for black and the process cartridge 6S (developing device 5S) for special color can be swapped.

The special color toner is not limited to one type, and in many cases, different types of toner containers 32S for special colors are installed as appropriate depending on usage. For example, the toner container 32S for clear toner may be replaced with the toner container 32S for white toner.

In such a case, depending on the type of special color toner, preferably the process cartridge 6S (developing device 5S) for special color is moved from an extreme upstream position to an extreme downstream position in the rotation direction of the intermediate transfer belt 8. For example, the clear toner as the special color toner is often used for improving the glossiness of an image, and it is desirable that the clear toner be primarily transferred onto the intermediate transfer belt 8 first. Accordingly, as illustrated in FIGS. 1 and 5A, the process cartridge 6S (developing device 5S) for special color is disposed at the extreme upstream position in the rotation direction of the intermediate transfer belt 8. On the other hand, white toner as the special color toner is often used for forming an image on a colored recording medium P that is not white, and it is desirable that the white toner be secondarily transferred in the lowermost layer on the recording medium P. Accordingly, the process cartridge 6S (developing device 5S) for special color is disposed at the extreme downstream position in the rotation direction of the intermediate transfer belt 8 as illustrated in FIG. 5B. With a rearrangement of the installation position of the process cartridge 6S (developing device 5S) for special color, the position of the process cartridge 6K (developing device 5K) for black is replaced with the position of the process cartridge 6S (developing device 5S). Users or service engineers manually performs the rearrangement operation according to procedures displayed on a control panel of the image forming apparatus 100.

Such a rearrangement of the process cartridge 6K for black (developing device 5K) and the process cartridge 6S (developing device 5S) for special color is described in more detail later.

Referring to FIG. 2, the process cartridge 6Y for yellow is a removable unit removably mounted in the apparatus body 100A and includes the photoconductor drum 1Y serving as an image bearer and further includes a charger 4Y, the developing device 5Y, and a cleaner 2Y disposed around the photoconductor drum 1Y. Image forming processes, namely, charging, exposure, development, transfer, and cleaning processes are performed on the photoconductor drum 1Y, and thus a yellow toner image is formed on the photoconductor drum 1Y.

Note that other process cartridges 6M, 6C, 6K, and 6S have a similar configuration to that of the process cartridge 6Y for yellow except the color of the toner used therein and form magenta, cyan, black, and special color toner images, respectively. Thus, only the process cartridge 6Y is described below and descriptions of other process cartridges 6M, 6C, 6K, and 6S are omitted.

Referring to FIG. 2, the photoconductor drum 1Y as the image bearer is rotated counterclockwise indicated by arrow A2 in FIG. 2 by a driving motor. The charger 4Y uniformly charges a surface of the photoconductor drum 1Y at a position opposite the charger 4Y (a charging process).

When the photoconductor drum 1Y reaches a position to receive a laser beam L emitted from the exposure device 7Y (i.e., a writing device), the photoconductor drum 1Y is scanned with the laser beam L, and thus an electrostatic latent image for yellow is formed thereon (an exposure process).

Then, the photoconductor drum 1Y reaches a position facing the developing device 5Y, where the electrostatic latent image is developed with toner into a yellow toner image (a development process).

When the surface of the photoconductor drum 1Y carrying the toner image reaches a position facing a primary transfer roller 9Y via the intermediate transfer belt 8 as an intermediate transferor, the toner image is transferred therefrom onto the intermediate transfer belt 8 (a primary transfer process). After the primary transfer process, a certain amount of residual, untransferred toner remains on the photoconductor drum 1Y.

When the surface of the photoconductor drum 1Y reaches a position facing the cleaner 2Y, a cleaning blade 2*a* collects the untransferred toner from the photoconductor drum 1Y into the cleaner 2Y (a cleaning process).

Subsequently, the surface of the photoconductor drum 1Y reaches a position facing the discharger, and the discharger eliminates residual potential from the photoconductor drum 1Y.

Thus, a sequence of image forming processes performed on the photoconductor drum 1Y is completed.

The above-described image forming processes are performed in the process cartridges 6M, 6C, 6K, and 6S similarly to the process cartridge 6Y for yellow. That is, the exposure devices 7M, 7C, 7K, and 7S disposed above the process cartridges 6M, 6C, 6K, and 6S emit the laser beams L according to image data onto respective photoconductor drums 1M, 1C, 1K, and 1S of the process cartridges 6M, 6C, 6K, and 6S. Specifically, the exposure device 7 includes light sources to emit the laser beams L, multiple optical elements, and a polygon mirror that is rotated by a motor. The laser beams L are directed to the respective photoconductor drums 1Y, 1M, 1C, 1K, and 15 via the multiple optical elements while being deflected by the polygon mirror.

Then, the toner images formed on the respective photoconductor drums 1Y, 1M, 1C, 1K, and 15 through the development process are primarily transferred therefrom and deposited one on another onto the intermediate transfer belt 8. Thus, a desired multicolor toner image is formed on the intermediate transfer belt 8.

In FIG. 1, the intermediate transfer device 15 includes the intermediate transfer belt 8 as the intermediate transferor, the five primary transfer rollers 9Y, 9M, 9C, 9K, and 9S, a driving roller, a secondary transfer backup roller, multiple tension rollers, a cleaning backup roller, and a belt cleaner. The intermediate transfer belt 8 is supported by and entrained around multiple rollers to rotate in the rotation direction (clockwise) indicated by arrow A1 illustrated in FIG. 1 as one (the driving roller) of the multiple rollers rotates.

Specifically, the five primary transfer rollers 9Y, 9M, 9C, 9K, and 9S are pressed against the corresponding photoconductor drums 1Y, 1M, 1C, 1K, and 1S with the intermediate transfer belt 8 therebetween. The five areas of contact between the primary transfer rollers 9Y, 9M, 9C, 9K, and 9S and the corresponding photoconductor drums 1Y, 1M, 1C, 1K, and 1S are hereinafter referred to as primary transfer nips. A transfer voltage (a primary transfer bias) opposite in polarity to the toner is applied to each of the primary transfer rollers 9Y, 9M, 9C, 9K, and 9S.

The intermediate transfer belt 8 rotates in the direction indicated by arrow A1 in FIG. 1 and sequentially passes through the primary transfer nips. Then, the single-color toner images are transferred from the respective photoconductor drums 1Y, 1M, 1C, 1K, and 1S primarily and deposited one on another onto the intermediate transfer belt 8.

Then, the intermediate transfer belt 8 carrying the multicolor toner image reaches a position facing the secondary transfer roller 19. The secondary transfer backup roller and the secondary transfer roller 19 press against each other via the intermediate transfer belt 8, and the contact portion therebetween is hereinafter referred to as a secondary transfer nip. The multicolor toner image on the intermediate transfer belt 8 is transferred onto a recording medium P such as a sheet transported to the secondary transfer nip (a secondary transfer process). A certain amount of toner untransferred to the recording medium P remains on the intermediate transfer belt 8 after the secondary transfer process.

Subsequently, the surface of the intermediate transfer belt 8 reaches a position facing the belt cleaner. There, the untransferred toner remaining on the intermediate transfer belt 8 is collected by the belt cleaner.

Thus, a sequence of image transfer processes performed on the intermediate transfer belt 8 is completed.

Referring back to FIG. 1, it is to be noted that the recording medium P is transported from a sheet feeder 26 (specifically, a sheet tray) disposed in a lower portion of the apparatus body 100A to the secondary transfer nip through a sheet feeding path K1, along which a sheet feeding roller 27 and a registration roller pair 28 are disposed.

Specifically, the sheet feeder 26 contains a stack of multiple sheets of recording media P. The sheet feeding roller 27 rotates counterclockwise in FIG. 1 to feed the recording medium P on the top of the stack in the sheet feeder 26 toward a nip of the registration roller pair 28.

The registration roller pair 28 (timing roller pair) stops rotating temporarily, stopping the recording medium P with a leading edge of the recording medium P nipped in the registration roller pair 28. The registration roller pair 28 rotates to transport the recording medium P to the secondary transfer nip, timed to coincide with the arrival of the multicolor toner image on the intermediate transfer belt 8. Thus, the multicolor toner image is transferred onto the recording medium P.

The recording medium P carrying the multicolor toner image is transported to a fixing device 20. In the fixing device 20, a fixing belt and a pressing roller apply heat and pressure to the recording medium P to fix the multicolor toner image on the recording medium P (a fixing process).

Subsequently, the recording medium P is transported through a discharge path K2 and discharged by a pair of discharge rollers outside the image forming apparatus 100. The recording media P are sequentially stacked as output images on a stack tray.

Thus, a series of image forming processes performed by the image forming apparatus 100 is completed.

Next, a configuration and operation of the developing device 5Y of the process cartridge 6Y is described in further detail below with reference to FIG. 2.

A casing of the developing device 5Y to contain the developer G is divided, at least partially, into two developer containing compartments. The developing device 5Y includes a developing roller 51 disposed facing the photoconductor drum 1Y, a doctor blade 52 disposed facing the developing roller 51, two conveying screws 55 respectively disposed in the developer containing compartments, a density detector 56 to detect concentration (percentage) of toner in developer G or toner density, and an opening 57 for supplying toner (developer) to the developer containing compartment. The developing roller 51 includes stationary magnets, a sleeve that rotates around the magnets, and the like. The developer containing compartments contain two-component developer G including carrier (carrier particles) and toner (toner particles).

The developing device 5Y operates as follows.

The sleeve of the developing roller 51 rotates in a direction indicated by arrow A3 illustrated in FIG. 2. The developer G is carried on the developing roller 51 by a magnetic field generated by the magnets. As the sleeve rotates, the developer G moves along a circumference of the developing roller 51.

The percentage (concentration) of toner in the developer G (ratio of toner to carrier) in the developing device 5Y is adjusted within a predetermined range. Specifically, according to the consumption of toner in the developing device 5Y, the toner supply device 90Y (illustrated in FIG. 3) supplies toner (i.e., powder) from the toner container 32Y (the developer container) to the developing device 5Y (the developer containing compartment in particular). A configuration and operation of the toner container 32Y and the toner supply device 90Y are described in further detail later.

While being stirred with the developer G and circulated by the two conveying screws 55 in the developing device 5Y (the developer containing compartments), the supplied toner is circulated between the two developer containing compartments in a longitudinal direction of the developing device 5Y, which is perpendicular to the surface of the paper on which FIG. 2 is drawn. The toner in two-component developer G is charged by friction with carrier and electrostatically attracted to the carrier. Then, the toner is carried on the developing roller 51 together with the carrier by a magnetic force generated on the developing roller 51.

The developer G carried on the developing roller 51 is transported in the clockwise direction indicated by arrow A3 in FIG. 2 to the doctor blade 52. The amount of developer G on the developing roller 51 is adjusted by the doctor blade 52, after which the developer G is carried to a developing range facing the photoconductor drum 1Y. Then, the toner in the developer G is attracted to the electrostatic latent image formed on the photoconductor drum 1Y due to the effect of an electric field generated in the developing range. As the sleeve rotates, the developer G remaining on the developing roller 51 reaches an upper part of the developer container, drops from the developing roller 51, and returns to the developer containing compartment.

Figure 3:
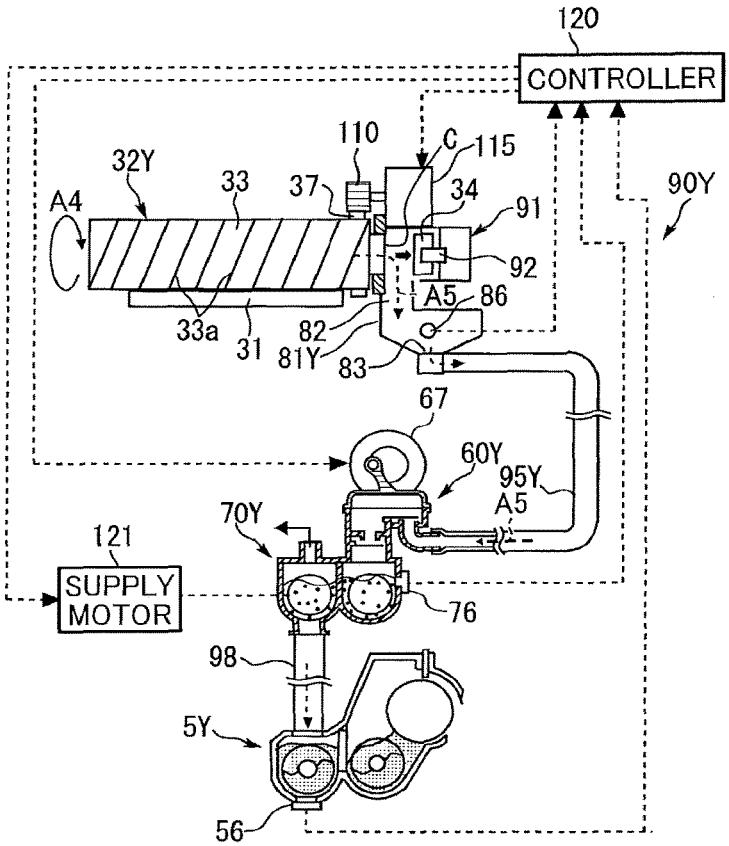
FIG. 3 is a schematic view of a developer supply device for color of the image forming apparatus illustrated in FIG. 1.

Next, a configuration and operation of the toner supply device 90Y for yellow illustrated in FIG. 3 is described.

In the present embodiment, the four other toner supply devices (the toner supply device 90M for magenta, the toner supply device 90C for cyan, the toner supply device 90K for black, and the toner supply device 90S for special color) have substantially the same configuration as that of the toner supply device 90Y for yellow, except that the color (type) of the toner to be used is different. Therefore, descriptions of the toner supply devices 90M, 90C, 90K, and 90S are appropriately omitted, and only the toner supply device 90Y for yellow is described.

The toner supply device 90Y rotates the toner container 32Y as the developer container installed in a toner container mount 31 in a predetermined direction (direction indicated by arrow A4 in FIG. 3), discharges the toner contained in the toner container 32Y to the outside of the toner container 32Y, and guides the toner to the developing device 5Y, thereby forming a toner supply route (a toner transport route).

In FIG. 3 (and FIG. 13 to be described later), the arrangement direction of the toner container 32Y, the toner supply device 90Y, and the developing device 5Y are changed for ease of understanding. In the present embodiment, the long axis of the toner container 32Y and a part of the toner supply device 90Y are perpendicular to the surface of the paper on which FIG. 3 is drawn (see FIG. 1). In addition, the orientation and arrangement of a tube 95Y (conveyance path) are also illustrated in a simplified manner.

The yellow toner contained in the toner container 32Y installed in the toner container mount 31 of the apparatus body 100A are supplied to the developing device 5Y by the toner supply devices 90Y corresponding to an amount of toner consumed in the developing device 5Y.

Specifically, when the toner container 32Y is set in the toner container mount 31 of the apparatus body 100A, a bottle gear 37 of the toner container 32Y meshes with the driving gear 110 of the apparatus body 100A and a cap chuck 92 of a cap receiver 91 removes a cap 34, which is for closing a toner outlet C, from the toner container 32Y. Accordingly, the toner outlet C of the toner container 32Y is opened, and the yellow toner is discharged from the toner container 32Y through the toner outlet C.

In the toner supply device 90Y, a reservoir 81Y is disposed below the toner outlet C via a downward path 82. A suction port 83 is disposed in the bottom portion of the reservoir 81Y, and the suction port 83 is coupled to one end of the tube 95Y (conveyance path) via a nozzle. The tube 95Y is formed of a flexible material with low affinity for toner, and the other end of the tube 95Y is coupled to a conveyance pump 60Y (diaphragm pump). The conveyance pump 60Y is coupled to the developing device 5Y via a sub-hopper 70Y and a conveyance pipe 98.

With such a configuration of the toner supply device 90Y, as the driving gear 110 is driven by a drive motor 115, a container body 33 of the toner container 32Y is rotated in a predetermined direction, thereby discharging toner from the toner outlet C of the toner container 32Y. Accordingly, toner discharged from the toner outlet C of the toner container 32Y falls through the downward path 82, and is stored in the reservoir 81Y. As the conveyance pump 60Y is operated, the toner stored in the reservoir 81 is sucked from the suction port 83 and is transported to the conveyance pump 60Y, and to the sub-hopper 70Y via the tube 95Y. Then, the toner conveyed to the sub-hopper 70Y is supplied into the developing device 5Y via the conveyance pipe 98 extending in the vertical direction. That is, the toner in the toner container 32Y is conveyed in the direction indicated by broken line arrows A5 in FIG. 3. In the present embodiment, unlike the tube 95Y, the conveyance pipe 98 that couples between the sub-hopper 70Y and the developing device 5Y is formed of a hard resin material or a metal material which is hardly deformed.

Next, the conveyance pump 60Y and the sub-hopper 70Y of the toner supply device 90Y are described in detail with reference to FIG. 4.

Figure 4:
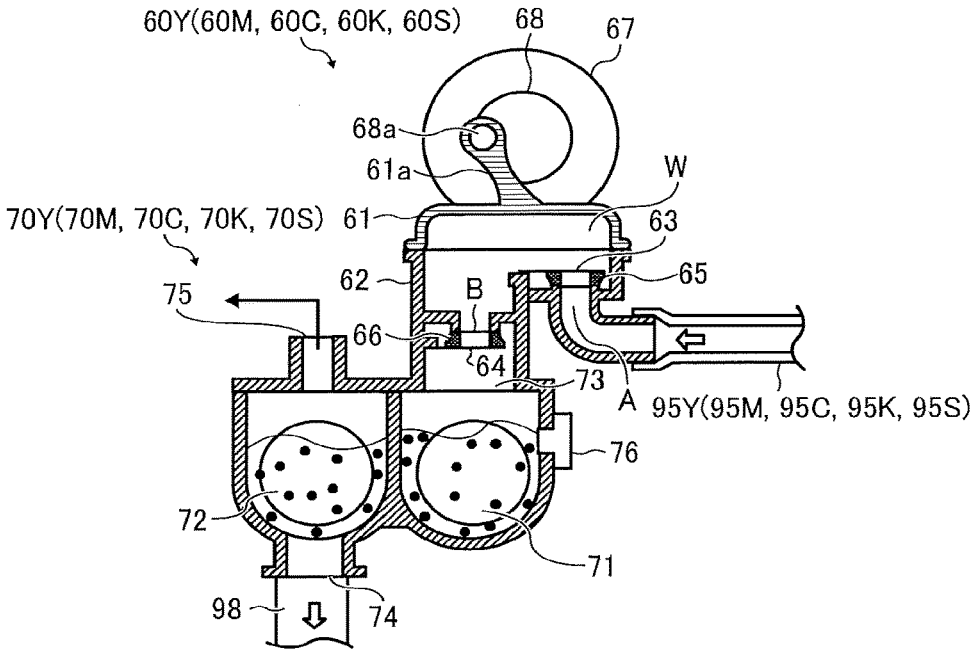
FIG. 4 is a cross-sectional view of a conveyance pump and a sub-hopper of the developer supply device in FIG. 3.

Referring to FIG. 4, the conveyance pump 60Y in the present embodiment is a diaphragm pump (positive displacement pump) and includes a diaphragm 61 (a rubber member), a case 62, a motor 67, a rotary plate 68, an inlet check valve 63 and an outlet check valve 64, seals 65 and 66 (elastic members), and the like. The conveyance pump 60Y with such a configuration is relatively small and low in cost.

The case 62 and the diaphragm 61 together form the body of the conveyance pump 60Y.

The case 62 is made of a resin material or a metal material having good rigidity and functions as a main part (housing) of the body of the conveyance pump 60Y. An inlet A for bringing the developer together with air into the interior and an outlet B for discharging the developer together with air from the interior are disposed in the case 62 (a pump body).

The diaphragm 61 is formed of a rubber material having elasticity and a low affinity for toner. The interior of the bowl-like portion functions as a variable volume portion W, and an arm 61*a* stands on the periphery thereof. An eccentric shaft 68*a* of the rotary plate 68 engages a hole of the arm 61*a*. The diaphragm 61 is joined with the case 62 without a gap, and the variable volume portion W of the diaphragm 61 and the inside of the case 62 are formed as one closed space inside the body of the conveyance pump 60Y (i.e., the pump body). The diaphragm 61 expands and contracts by the rotary plate 68 (the eccentric shaft 68*a*) to be described later, thereby increasing and decreasing the internal volume. Therefore, the body of the conveyance pump 60Y (i.e., the diaphragm 61 and the case 62) alternately generate the positive pressure and the negative pressure.

The rotary plate 68 is disposed on the motor shaft of the motor 67, and the eccentric shaft 68*a* is provided on the surface thereof so as to stand upright at a position offset from the motor shaft (rotational center). The eccentric shaft 68*a* of the rotary plate 68 is inserted (fitted) into the hole formed in a tip of the arm 61*a* of the diaphragm 61.

With this configuration, as the motor 67 is driven by a controller 120, the rotary plate 68 (the eccentric shaft 68*a*) rotates. Accordingly, the diaphragm 61 expands and contracts so as to increase and decrease the volume of the variable volume portion W periodically. With such expansion and contraction of the diaphragm 61, the positive pressure and the negative pressure are alternately generated inside the pump body composed of the diaphragm 61 and the case 62.

The inlet check valve 63 is disposed at the inlet A of the pump body (the case 62). The inlet check valve 63 opens the inlet A when the negative pressure is generated inside the pump body (the diaphragm 61 and the case 62) and closes the inlet A when the positive pressure is generated inside the pump body. The inlet check valve 63 is provided to face the inlet A from the inside of the pump body. The reservoir 81Y is coupled to the inlet A of the conveyance pump 60Y via the tube 95Y.

On the other hand, the outlet check valve 64 is disposed at the outlet B of the pump body (the case 62). The outlet check valve 64 closes the inlet B when the negative pressure is generated inside the pump body and opens the outlet B when the positive pressure is generated inside the pump body. The outlet check valve 64 is provided to face the outlet B from the outside of the pump body. The sub-hopper 70Y is coupled to the outlet B of the conveyance pump 60Y.

With such a configuration and operation, as described above with reference to FIG. 3, as the conveyance pump 60Y operates, the toner stored in the reservoir 81Y, serving as a supply source, is sucked from the suction port 83 and conveyed into the sub-hopper 70Y through the tube 95Y. Specifically, when a hopper sensor 76 of the sub-hopper 70Y detects a shortage of toner in the sub-hopper 70Y, the conveyance pump 60Y (the motor 67) is driven to supply toner from the reservoir 81Y to the sub-hopper 70Y.

When the hopper sensor 76 detects that the amount of toner in the sub-hopper 70Y has not reached a predetermined amount and an insufficient state is detected, similarly to the known one, the conveyance pump 60Y (the motor 67) is intermittently driven in short cycles. As a result, the amount of toner conveyed by a first conveyance screw 71 and a second conveyance screw 72 in the sub-hopper 70Y can catch up with the amount of toner supplied from the conveyance pump 60Y, thereby preventing toner from stagnating in a part of the sub-hopper 70Y.

Referring to FIG. 4, the first conveyance screw 71, the second conveyance screw 72, the hopper sensor 76, a supply motor 121 (see FIG. 3), and the like are provided in the sub-hopper 70Y (a supply destination). A supply port 73 communicating with the outlet B of the conveyance pump 60Y is disposed above an upstream side of a first conveying path of the sub-hopper 70Y in the direction of conveyance of toner. The first conveyance screw 71 is disposed in the first conveying path. A discharge port 74 is disposed under a downstream side of a second conveying path of the sub-hopper 70Y in the direction of conveyance of toner, and communicates with the developing device 5Y via the conveyance pipe 98. The second conveyance screw 72 is disposed in the second conveying path. Further, an exhaust port 75 for discharging air fed together with the toner from the conveyance pump 60Y is disposed above the second conveying path of the sub-hopper 70Y.

As described above, the hopper sensor 76 detects the insufficient state in which the amount of toner (developer) contained in the sub-hopper 70Y is below the predetermined amount.

In the sub-hopper 70Y, a downstream side of the first conveying path and an upstream side of the second conveying path communicate with each other (i.e. a communicating portion) on one end side in the longitudinal direction of the sub-hopper 70Y perpendicular to the paper on which FIGS. 3 and 4 are drawn. The first conveying path and the second conveying path are separated by the wall except for the communicating portion.

The toner supplied into the sub-hopper 70Y is conveyed through the first conveying path and the second conveying path in the sub-hopper 70Y by the first conveyance screw 71 and the second conveyance screw 72 rotated by the supply motor 121 and is supplied to the developing device 5Y via the conveyance pipe 98. Specifically, when the density detector 56 of the developing device 5Y detects a shortage of the toner concentration in the developer containing compartment (a circulation path in which the conveying screw 55 circulates the toner), the controller 120 rotates the first conveyance screw 71 and the second conveyance screw 72 of the sub-hopper 70Y, thereby supplying the toner from the sub-hopper 70Y to the developing device 5Y.

As described above, in the present embodiment, the conveyance path extending from the reservoir 81Y to the conveyance pump 60Y is formed with the flexible tube 95Y. Therefore, even when various components are installed in the space between the reservoir 81Y and the conveyance pump 60Y, the tube 95Y can be installed avoiding those components to secure the conveyance path. Therefore, the toner container mount 31 of the toner container 32Y can be freely laid out at a position away from the developing device 5Y.

Next, referring to FIG. 3, configurations of the toner container 32Y and the toner supply device 90Y are described below.

As described above, the toner container 32Y includes the container body 33 and the cap 34 detachably attachable to toner outlet C of the container body 33.

A bottle gear 37 that rotates together with the container body 33 and the toner outlet C are disposed on a head portion of the container body 33. The bottle gear 37 meshes with the driving gear 110 of the apparatus body 100A, and the driving gear 110 rotates the container body 33 with the bottle gear 37 in a predetermined direction. The toner outlet C is for discharging toner (powder) from the container body 33 to the downward path 82.

The container body 33 includes a helical protrusion 33*a* protruding inward from an outer circumferential face to an inner circumferential face thereof. In other words, a helical groove is provided in the outer circumferential face of the container body. The helical protrusion 33*a* is for discharging toner from the container body 33 through the toner outlet C of the toner container 32Y by rotation of the container body 33.

The container body 33 may be produced together with the bottle gear 37 as a single unit by blow molding.

Referring to FIG. 3, the cap receiver 91 of the toner supply device 90Y covers the head portion of the toner container 32Y installed in the toner container mount 31 (the toner supply device 90Y).

The cap receiver 91 includes the cap chuck 92 for opening and closing the cap 34 in conjunction with the installation and removal operation of the toner container 32Y and an opening-closing driver for driving the cap chuck 92. The cap receiver is a part of the receiver 81Y as well as the downward path 82. Then, as the toner container 32Y mounted on the toner container mount 31 is slid toward the cap receiver 91 and the cap 34 reaches a position of the cap chuck 92, the opening-closing driver operates so that the cap 34 is separated from the toner outlet C in a state where the cap chuck 92 holds the cap 34 in conjunction with an operation of the toner container 32Y that is slid further and pushed in. Thus, the toner outlet C of the toner container 32Y is opened, and toner can be discharged from the toner outlet C. Further, in conjunction with the installation operation of the toner container 32Y, the locking mechanism is operated to lock the head portion of the toner container 32Y so as not to be removed from the toner container mount 31. At that time, the toner container 32Y is secured to the toner supply device 90Y so that the toner discharge port C side (head) of the toner container 32Y is rotatable, and the container body 33 is rotatably supported on the toner container mount 31.

In removal of the toner container 32Y from the toner container mount 31, the above-described processes are performed in reverse.

Toner discharged from the toner container 32Y drops through the downward path 82 to the bowl-shaped reservoir 81Y of the toner supply device 90Y and stored therein. The reservoir 81Y includes a toner detector 86 and a stirring member. The conveyance pump 60Y coupled to the suction port 83 of the reservoir 81Y via the tube 95Y sucks the toner in the reservoir 81Y and conveys the toner through the tube 95Y.

As described above, in the present embodiment, the toner discharged from the toner container 32Y is not directly sucked by the conveyance pump 60Y but is stored in the reservoir 81Y to some extent. Then, the conveyance pump 60Y sucks the necessary amount of toner. Accordingly, such a configuration can minimize shortage of the toner sucked by the conveyance pump 60Y.

The toner detector 86 is disposed near the suction port 83 and indirectly detects a state in which the toner contained in the toner container 32Y is depleted (toner depletion), or a state close thereto (toner near depletion). Then, the toner is discharged from the toner container 32Y based on the detection result of the toner detector 86.

For example, a piezoelectric sensor or a light transmission sensor can be used as the toner detector 86. In the present embodiment, a piezoelectric sensor is used as the toner detector 86. The height of the detection surface of the toner detector 86 is set so that the amount of toner (deposition height) deposited above the suction port 83 is a target value.

Based on the detection result of the toner detector 86, the controller 120 controls a drive timing and a drive duration of the drive motor 115 to rotationally drive the toner container 32Y (the container body 33). Specifically, when the controller 120 determines that there is no toner at the detection position based on the detection result of the toner detector 86, the drive motor 115 is driven for a predetermined time. On the other hand, when the controller 120 determines that the toner is present at the detection position based on the detection result of the toner detector 86, the drive motor 115 is stopped.

Next, referring to FIGS. 5A and 5B, the configuration and operation of the image forming apparatus 100 according to the present embodiment are described below.

As described in FIG. 1, in the image forming apparatus 100 according to the present embodiment, the plurality of photoconductor drums 1Y, 1M, 1C, 1K, and 1S as the image bearer are arranged side by side along the intermediate transfer belt 8 in the rotation direction of the intermediate transfer belt 8. The intermediate transfer belt 8 as the intermediate transferor rotates in a predetermined direction (clockwise in FIG. 1). As illustrated in FIGS. 5A and 5B, the image forming apparatus 100 further includes the plurality of developing devices 5Y, 5M, 5C, 5K, and 5S to develop latent images formed on the plurality of photoconductor drums 1Y, 1M, 1C, 1K, and 1S (image bearers); the plurality of toner containers 32Y, 32M, 32C, 32K, and 32S (developer containers) each containing the toner as the developer; the plurality of tubes 95Y, 95M, 95C, 95K, and 95S as conveyance paths to supply the toner contained in the plurality of toner containers 32Y, 32M, 32C, 32K, and 32S to the plurality of developing devices 5Y, 5M, 5C, 5K, and 5S respectively.

In the present embodiment, as described above, if necessary, the arrangement order of the plurality of developing devices 5Y, 5M, 5C, 5K, and 5S in the rotation direction of the intermediate transfer belt 8 is changed while the arrangement of the plurality of toner containers 32Y, 32M, 32C, 32K, and 32S (developer containers) is not changed. The layout of the plurality of tubes 95Y, 95M, 95C, 95K, and 95S (the conveyance paths) is changed so that the connections between supply sources and supply destinations of the plurality of tubes 95Y, 95M, 95C, 95K, and 95S remains the same.

Specifically, as described above, each of the plurality of developing devices 5Y, 5M, 5C, 5K, and 5S together with the corresponding one of the plurality of photoconductor drums 1Y, 1M, 1C, 1K, and 1S forms the corresponding one of the process cartridges 6Y, 6M, 6C, 6K, and 6S. Therefore, the plurality of process cartridges 6Y, 6M, 6C, 6K, and 6S is rearranged in the rotation direction of the intermediate transfer belt 8, without changing the arrangement of the plurality of toner containers 32Y, 32M, 32C, 32K, and 32S. In addition, the layout of the plurality of tubes 95Y, 95M, 95C, 95K, and 95S is changed without changing the connections between the supply sources and the supply destinations of the plurality of tubes 95Y, 95M, 95C, 95K, and 95S.

More specifically, the plurality of conveyance pumps 60Y, 60M, 60C, 60K, and 60S are detachably coupled to downstream openings of the plurality of tubes 95Y, 95M, 95C, 95K, and 95S (the conveyance paths), respectively. Further, the plurality of reservoirs 81Y, 81M, 81C, 81K, and 81S are coupled to upstream openings of the plurality of tubes 95Y, 95M, 95C, 95K, and 95S (the conveyance paths), respectively. In the present embodiment, the reservoirs 81Y, 81M, 81C, 81K, and 81S are the supply sources for the tubes 95Y, 95M, 95C, 95K, and 95S.

The plurality of sub-hoppers 70Y, 70M, 70C, 70K, and 70S is coupled to the plurality of conveyance pumps 60Y, 60M, 60C, 60K, and 60S and the plurality of developing devices 5Y, 5M, 5C, 5K, and 5S, respectively. In the present embodiment, the sub-hoppers 70Y, 70M, 70C, 70K, and 70S are the supply destinations for the tubes 95Y, 95M, 95C, 95K, and 95S.

In the present embodiment, the plurality of process cartridges 6Y, 6M, 6C, 6K, and 6S; the plurality of conveyance pumps 60Y, 60M, 60C, 60K, and 60S; and the plurality of sub-hoppers 70Y, 70M, 70C, 70K, and 70S are rearranged in the rotation direction of the intermediate transfer belt 8, without changing the arrangement of the plurality of toner containers 32Y, 32M, 32C, 32K, and 32S, and without changing the connections among the plurality of process cartridges 6Y, 6M, 6C, 6K, and 6S; the plurality of conveyance pumps 60Y, 60M, 60C, 60K, and 60S; and the plurality of sub-hoppers 70Y, 70M, 70C, 70K, and 70S. In addition, the layout of the plurality of tubes 95Y, 95M, 95C, 95K, and 95S is changed without changing the connections between the plurality of tubes 95Y, 95M, 95C, 95K, and 95S (conveyance paths) and the plurality of conveyance pumps 60Y, 60M, 60C, 60K, and 60S.

With this configuration, according to the present embodiment, without changing the connections between the plurality of conveyance pumps 60Y, 60M, 60C, 60K, and 60S and the plurality of tubes 95Y, 95M, 95C, 95K, and 95S to supply toner to the plurality of developing devices 5Y, 5M, 5C, 5K, and 5S, and without changing the arrangement of the plurality of toner containers 32Y, 32M, 32C, 32K, and 32S, the arrangement of the plurality of developing devices 5Y, 5M, 5C, 5K, and 5S is changed, and the layout of the plurality of tubes 95Y, 95M, 95C, 95K, and 95S is changed. Therefore, the order of the overlapping toner colors on the intermediate transfer belt 8 (or the recording medium P) can be easily changed without multiple rotations of the intermediate transfer belt 8. Accordingly, as described above, an optimum image can be formed.

More specifically, in the present embodiment, as illustrated in FIGS. 5A and 5B, without changing the arrangement of the plurality of toner containers 32Y, 32M, 32C, 32K, and 32S (and the plurality of reservoirs 81Y, 81M, 81C, 81K, and 81S), the developing device 5S located at the extreme upstream position and the developing device 5K located at the extreme downstream position are swapped, and the layout of two tubes 95K and 95S of the plurality of tubes 95Y, 95M, 95C, 95K, and 95S corresponding to the developing devices 5S and 5K is changed. In the present embodiment, one of the two swapped developing devices is the developing device 5S for a special color, and the other is the developing device 5K for black.

The length in a direction in which the toner is conveyed (hereinafter "conveyance direction") of each of the above-mentioned two tubes 95K and 95S is set in accordance with the sub-hopper positioned farther out of the two developing devices 5K and 5S from corresponding two of the plurality of developer containers.

Therefore, in the rearrangement operation of the developing devices 5K and 5S (the process cartridges 6K and 6S) from the state A illustrated in FIG. 5A to the state B illustrated in FIG. 5B (or from the state B illustrated in FIG.

5B to the state A illustrated in FIG. 5A), the tubes 95K and 95S are long enough to change the layout of the tubes 95K and 95S.

In the present embodiment, the two developing devices (the developing device 5S for a special color and the developing device 5K for black) at both ends in the rotation direction of the intermediate transfer belt 8 are swapped.

Figure 6A:
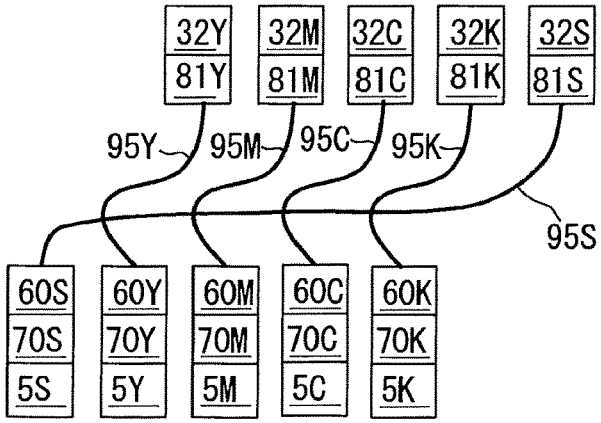
FIG. 6A is a block diagram illustrating the arrangement of components of the image forming apparatus illustrated in FIG. 1 when toner images are primarily transferred in the order of special color, color, and black from the upstream side in the rotation direction of the intermediate transfer belt in the image forming apparatus illustrated in FIG. 1.
Figure 6B:
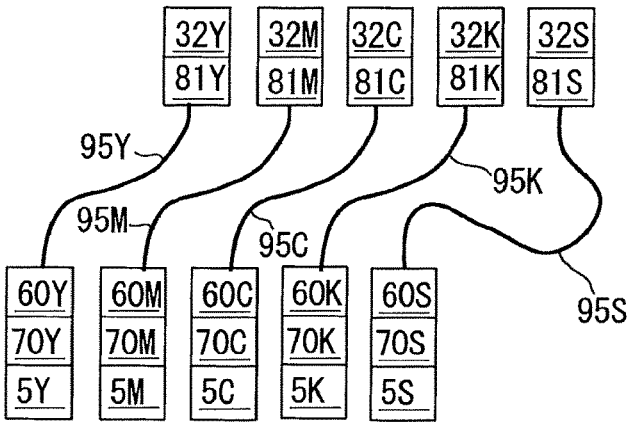
FIG. 6B is a block diagram illustrating the arrangement of components of the image forming apparatus illustrated in FIG. 1 when toner images are primarily transferred in the order of color, black, and special color from the upstream side in the rotation direction of the intermediate transfer belt in the image forming apparatus illustrated in FIG. 1.

On the other hand, as illustrated in FIGS. 6A and 6B, without changing the arrangement of the five toner containers 32Y, 32M, 32C, 32K, and 32S, the developing device 5K (and the conveyance pump 60K and the sub-hopper 70K) for black and the developing devices 5Y, 5M, and 5C (and the conveyance pumps 60Y, 60M, and 60C and the sub-hoppers 70Y, 70M, and 70C) for colors can move one by one to the next position without changing the order of arrangement thereof, the developing device 5S (and the conveyance pump 60S and the sub-hopper 70S) can move to the extreme upstream position or to the extreme downstream position, and the layout of five tubes 95Y, 95M, 95C, 95K and 95S can be changed.

In such a configuration, the order of the special color toner to be deposited on the surface of the intermediate transfer belt 8 (or the recording medium P) becomes the target order (the uppermost or the lowermost), and the order of the black toner and the color toners to be deposited on the intermediate transfer belt 8 (or the recording medium P) is always constant. Specifically, in the present embodiment, the order of the black toner and the color toners deposited onto the surface of the intermediate transfer belt 8 is in the order of yellow, magenta, cyan, and black from the bottom. Further, the order of the black toner and the color toners deposited on the surface of the recording medium P is reversed.

Therefore, even when the arrangement is changed as described above, the color of the image ultimately formed on the surface of the recording medium P (which is an image formed by the black toner and the color toner) is hardly changed. Accordingly, an optimum image can be formed without changing color to meet the intended use.

In the case of rearrangement illustrated in FIGS. 6A and 6B, the tube 95K corresponding to the developing device 5K for black and the tubes 95Y, 95M, and 95C corresponding to the developing devices 5Y, 5M, and 5C for colors have lengths in the conveyance direction of toner that are set in accordance with a state in which the developing device 5K for black and the developing devices 5Y, 5M, and 5C for colors move one by one to the next position in rotation direction of the intermediate transfer belt 8.

Therefore, in the rearrangement operation of the developing devices 5Y, 5M, 5C, 5K, and 5S (the process cartridges 6Y, 6M, 6C, 6K, and 6S) from the state A illustrated in FIG. 6A to the state B illustrated in FIG. 6B (or from the state B illustrated in FIG. 6B to the state A illustrated in FIG. 6A), the tubes 95Y, 95M, 95C, 95K, and 95S are long enough to enable the layout of the tubes 95Y, 95M, 95C, 95K, and 95S to be rearranged.

In the case of rearrangement illustrated in FIGS. 6A and 6B, the length of the tube 95S corresponding to the developing device 5S for special color is set in accordance with the developing device located farther of the two developing devices of the extreme upstream and the extreme downstream from the toner container 32S.

The image forming apparatus 100 according to the present embodiment preferably includes a tube housing 108 to accommodate a part of at least one tube 95 of the plurality of tubes 95Y, 95M, 95C, 95K, and 95S. The tube 95 is wound or folded inside the tube housing 108 without buckling.

Specifically, as illustrated in FIGS. 5A and 5B, both the tube 95S for special color and the tube 95K for black are long enough to change the layouts thereof in conjunction with rearrangement of the developing devices 5S and 5K. Therefore, when the tube 95K or 95S are coupled to nearer developing device 5 (conveyance pump 60) out of the two developing devices 5K and 5S, the length of the tube 95K or 95S becomes excessive.

Figure 7A:
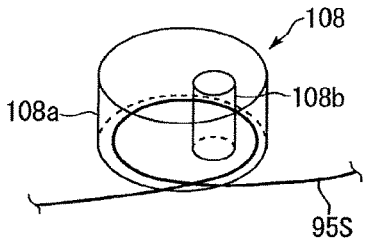
FIGS. 7A and 7B are schematic perspective views of one tube housing of the developer supply device.
Figure 7B:
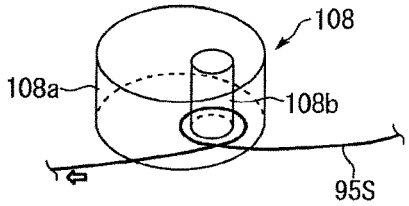

On the other hand, as illustrated in FIGS. 7A and 7B, the tube housing 108 can reel in a portion of the tube 95S without buckling and therefore can eliminate slack in and prevent entanglement of the tube 95S without reducing ability to convey toner. Note that, in FIGS. 7A and 7B, only the tube housing 108 for accommodating the tube 95S for special color is illustrated, and the illustration of the tube housing for accommodating the tube 95K for black is omitted.

More specifically, as illustrated in FIGS. 7A and 7B, the tube housing 108 is a cylindrical member having a core shaft 108*b* therein, around which the tube 95S winds once inside the cylindrical portion 108*a*. The tube housing 108 is shaped to allow the size of winding of the tube 95S to change. That is, when the distance between both ends (an end portion coupled to the supply source and an end portion coupled to the supply destination) of the tube 95S is short as illustrated in FIG. 5B, the size of winding of the tube 95S circling around the core shaft 108*b* is enlarged to be closer to the inner wall of the cylindrical portion 108*a* as illustrated in FIG. 7A. On the other hand, when the distance between both ends of the tube 95S is long as illustrated in FIG. 5A, the size of winding of the tube 95S circling around the core shaft 108*b* is reduced so that the tube 95S becomes closer to the core shaft 108*b* as illustrated in FIG. 7B.

It is to be noted that the inner wall of the cylindrical portion 108*a* of the tube housing 108 has a curvature larger than the maximum curvature at which buckling occurs in the tube 95S.

Figure 8A:
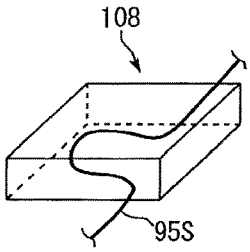
FIGS. 8A and 8B are schematic perspective views of another tube housing of the developer supply device.
Figure 8B:
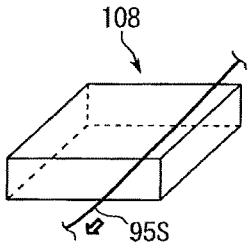

In addition to the configuration illustrated in FIGS. 7A and 7B, the tube housing 108 can be configured to fold a part of the tube 95S without buckling as illustrated in FIGS. 8A and 8B.

When the distance between both ends of the tube 95S is short, the tube 95S is folded into a substantially wave shape with moderate curvature inside the tube housing 108 as illustrated in FIG. 8A. On the other hand, when the distance between both ends of the tube 95S is long, the folding of the tube 95S is eliminated and the tube 95S is stretched inside the tube housing 108 as illustrated in FIG. 8B.

Figure 9:
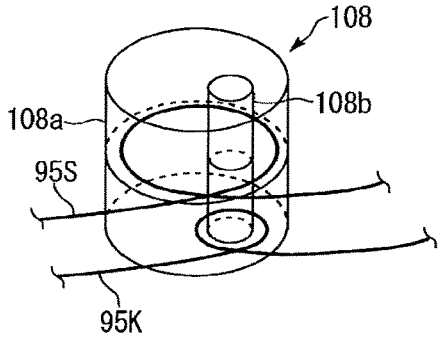
FIG. 9 is a schematic perspective view of yet another tube housing of the developer supply device.

Alternatively, as illustrated in FIG. 9, a plurality of tube housings 108 (for example, one for special color and one for black) can be stacked one on another. In the present embodiment, as illustrated in FIGS. 5A and 5B, when the tube 95S for special color is long (or short), the tube 95K for black is short (or long). Therefore, the winding state of the two tubes 95K and 95S is opposite each other as illustrated in FIG. 9.

Here, in the present embodiment, at least one of the plurality of tubes 95Y, 95M, 95C, 95K, and 95S can be covered with a reinforcing member 105 to reinforce the tube 95 so that the tube 95 does not crimp.

Figure 10:
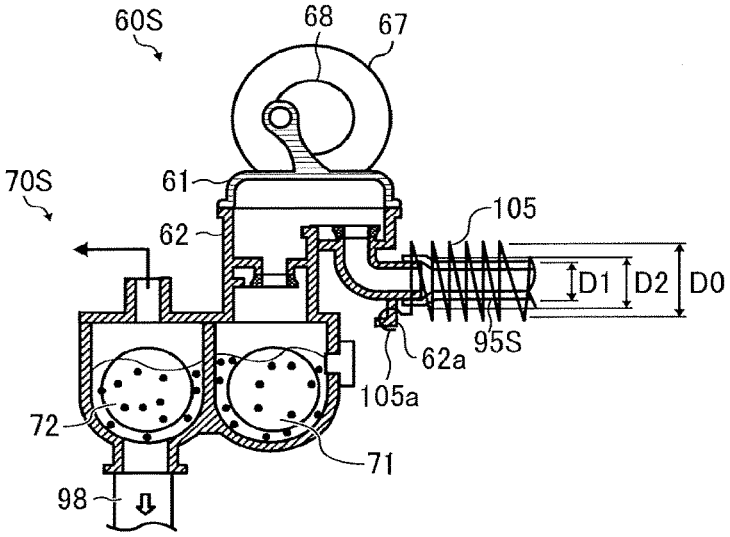
FIG. 10 is a schematic view of a reinforcing member, which is secured to the conveyance pump, of the tube of the developer supply device.
Figure 11:
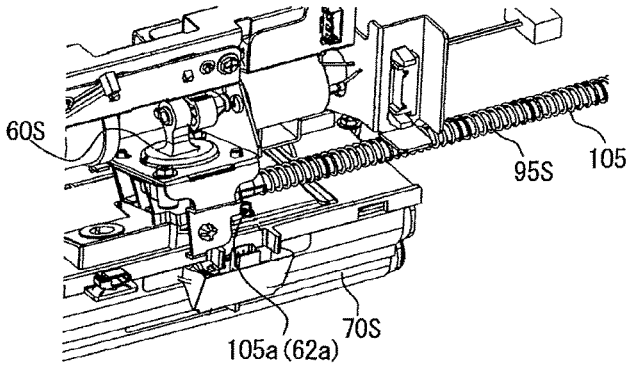
FIG. 11 is a perspective view of the reinforcing member, which is secured to the conveyance pump, of the tube of the developer supply device.

Specifically, as illustrated in FIGS. 10 and 11, the reinforcing member 105 is, for example, a coil wound around the tube 95S so as to cover the outer periphery of the tube 95S over the entire region in the conveyance direction of the tube 95S. Thus, the reinforcing member 105 prevents buckling of the flexible tube 95S causing decrease of the ability to convey toner of the tube 95S.

In FIGS. 10 and 11, the reinforcing member 105 is installed in the tube 95S for special color, but the reinforcing member 105 can also be installed in the other tubes 95Y, 95M, 95C, and 95K.

The downstream opening or the upstream opening of the tube 95S is detachably coupled to a connection portion of the supply destination or the supply source. In this case, the reinforcing member 105 preferably includes a hook 105*a* (an engaged portion) to engage an engagement portion of the connection portion.

Specifically, as illustrated in FIGS. 10 and 11, the downstream opening of the tube 95S is detachably coupled to the case 62 serving as the connection portion of the sub-hopper 70S as the supply destination. With this configuration, the layout of the tube 95S can be changed at the time of rearrangement of the developing devices 5S and 5K described above. However, when changing the layout of the tube 95S, it is necessary to attach and detach the reinforcing member 105 wound around the tube 95S. As illustrated in FIGS. 10 and 11, the case 62 as the connection portion includes a hooked portion 62*a* as the engagement portion. The hook 105*a* as the engaged portion disposed on the tip of the reinforcing member 105 is hooked on the hooked portion 62*a*, and the reinforcing member 105 is positioned by the spring force acting on the coiled reinforcing member 105. Further, when detaching the reinforcing member 105, the engagement between the hook 105*a* and the hooked portion 62*a* is released against the spring force acting on the coiled reinforcing member 105. At that time, the releasing operation is relatively simple without requiring such a large force.

When attaching the reinforcing member 105 for preventing buckling of the tube 95S, as illustrated in FIG. 10, it is preferable that a relationship of D0>D2>D1 is satisfied, where D0 is an inner diameter of the reinforcing member 105, D1 is an outer diameter of the tube 95S by oneself, and D2 is an outer diameter of the tube 95S in a coupled state with the connection portion.

With such a configuration, the reinforcing member 105 is wound loosely around the tube 95S over the entire region in the conveyance direction of the tube 95S. Therefore, the above-described attaching and detaching operation of the reinforcing member 105 to the tube 95S can be performed more easily.

In the present embodiment, at least one of the plurality of tubes 95Y, 95M, 95C, 95K, and 95S can be provided with a rotary portion 109 to rotate at least a part of the tube 95 to avoid twisting the tube 95.

Figure 12A:
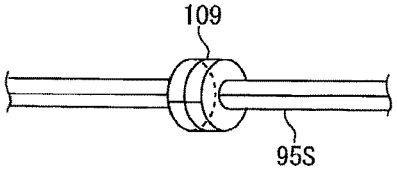
FIGS. 12A and 12B are schematic perspective views of a rotary portion of the tube of the developer supply device to prevent tube twisting.
Figure 12B:
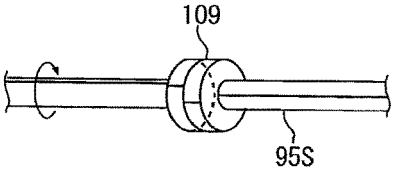

Specifically, as illustrated in FIGS. 12A and 12B, the rotary portion 109 is attached to the center (or in the middle of the conveyance path) of the tube 95S. The tube 95S on one end side can rotate relative to the tube 95S on the other end side with the rotary portion 109 as a boundary while maintaining the ability to convey toner of the entire tube 95S. Specifically, a part of the rotary portion 109 coupled to the tube 95S on the one end side can rotate relative a part of the rotary portion 109 coupled to the tube 95S on the other end side while always matching the inner diameter portions of the both parts.

By providing the rotary portion 109 to the tube 95S in this manner, even if a force that causes twisting of the tube 95S illustrated in FIG. 12A is exerted, the tube 95S on the one end side rotates relative to the tube 95S on the other end side as illustrated in FIG. 12B, so that the tube 95S does not twist. Therefore, the ability to convey toner of the tube 95S is favorably maintained.

The rotary portion 109 can also be disposed at the end (a connecting portion) of the tube 95S.

As described above, in the image forming apparatus 100 according to the present embodiment, the arrangement of the plurality of developing devices 5Y, 5M 5C, 5K, and 5S in the rotation direction of the intermediate transfer belt 8 (the intermediate transferor) is changed while satisfying the following. The arrangement of the plurality of toner containers 32Y, 32M, 32C, 32K, and 32S (the developer containers) is not changed. The layout of the plurality of tubes 95Y, 95M, 95C, 95K, and 95S is changed so that the connections between the supply source and the supply destination of the plurality of tubes 95Y, 95M, 95C, 95K, and 95S (the conveyance paths) is not changed.

Accordingly, the arrangement of the plurality of developing devices 5Y, 5M, 5C, 5K, and 5S can simply be changed to change the order of toner colors deposited on the surface of the intermediate transfer belt 8.

A detailed description is provided below of a second embodiment referring to FIGS. 13 through 17D.

Figure 13:
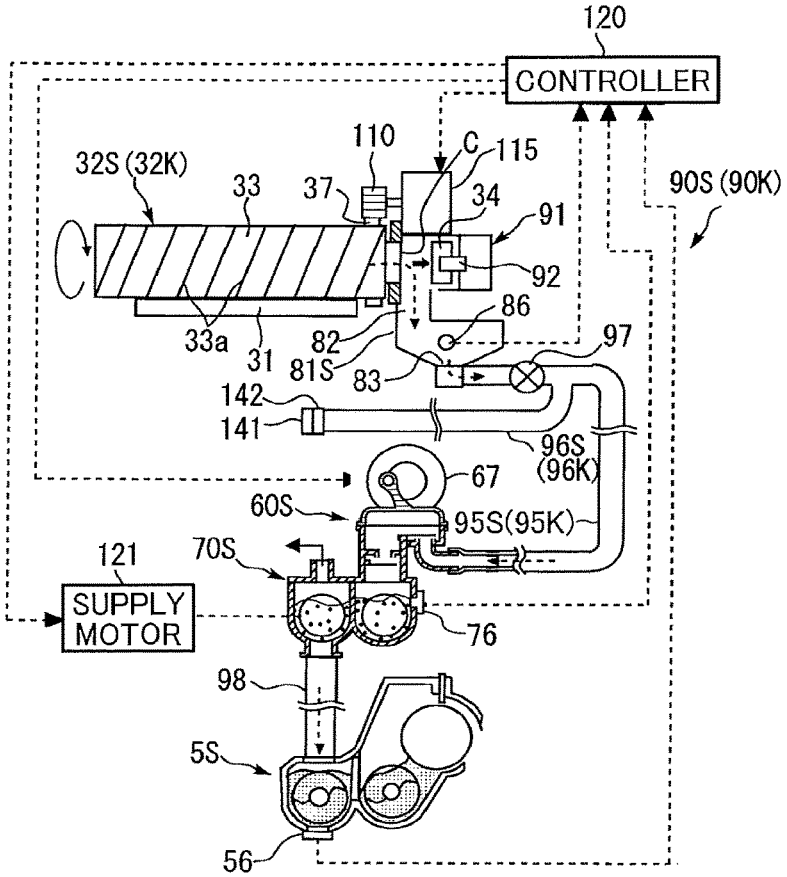
FIG. 13 is a schematic view of a developer supply device for black or special color toner of the image forming apparatus illustrated in FIG. 1.

FIG. 13 is a schematic view of the toner supply device 90S or 90K of the image forming apparatus 100.

The toner supply device 90S for special color and the toner supply device 90K for black according to the second embodiment are different in configuration from those according to the first embodiment. The rearrangement of the process cartridges 6S and 6K (the developing devices 5S and 5K) described above referring to FIGS. 5A and 5B can be smoothly performed without troubles such as color mixing of toner.

In the image forming apparatus 100 according to the second embodiment, the arrangement of the plurality of developing devices 5Y, 5M, 5C, 5K, and 5S (the plurality of process cartridges 6Y, 6M, 6C, 6K, and 6S; the plurality of conveyance pump 60Y, 60M, 60C, 60K, and 60S; and the plurality of sub-hoppers 70Y, 70M, 70C, 70K, and 70S) in the rotation direction of the intermediate transfer belt 8 (the intermediate transferor) can be changed while satisfying the following. The arrangement of the plurality of toner containers 32Y, 32M, 32C, 32K, and 32S (and the plurality of reservoirs 81Y, 81M, 81C, 81K, and 81S) is not changed. The layout of the plurality of tubes 95Y, 95M, 95C, 95K, and 95S is changed so that the connections between the supply source and the supply destination of the plurality of tubes 95Y, 95M, 95C, 95K, and 95S (the conveyance paths) is not changed.

Figure 16A:
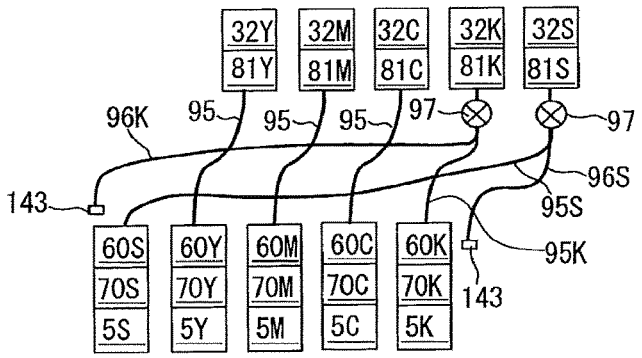
FIG. 16A is a block diagram illustrating the arrangement of components of the image forming apparatus illustrated in FIG. 1 when toner images are primarily transferred in the order of special color, color, and black from the upstream side in the rotation direction of the intermediate transfer belt in the image forming apparatus illustrated in FIG. 1.
Figure 16B:
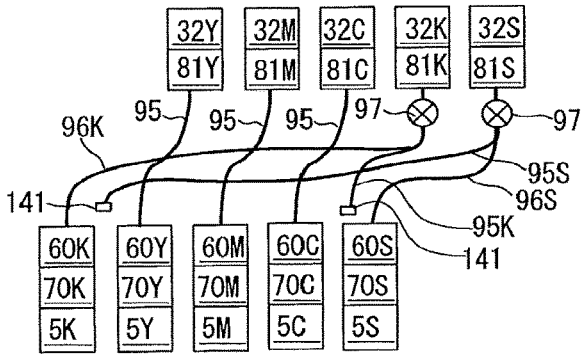
FIG. 16B is a block diagram illustrating the arrangement of components of the image forming apparatus illustrated in FIG. 1 when toner images are primarily transferred in the order of black, color, and special color from the upstream side in the rotation direction of the intermediate transfer belt in the image forming apparatus illustrated in FIG. 1.

In particular, in the second embodiment, as illustrated in FIGS. 16A and 16B, without changing the arrangement of the plurality of toner containers 32Y, 32M, 32C, 32K, and 32S (and the plurality of reservoirs 81Y, 81M, 81C, 81K, and 81S), the developing device 5S (the process cartridge 6S, the conveyance pump 60S, and sub-hopper 70S) located at the extreme upstream position and the developing device 5K (the process cartridge 6K, the conveyance pump 60K, and sub-hopper 70K) located at the extreme downstream position can be swapped, and the layout of two tubes 95K and 95S of the plurality of tubes 95Y, 95M, 95C, 95K, and 95S corresponding to the two developing devices 5S and 5K can be changed.

Three toner supply devices 90Y, 90M, and 90C according to second embodiment have a configuration similar to that according to the first embodiment illustrated in FIG. 3.

Specifically, the clear toner as the special color toner is often used for improving the glossiness of images, and it is desirable that the clear toner be primarily transferred onto the intermediate transfer belt 8 first. Specifically, the clear toner as the special color toner is often used for improving the glossiness of an image, and it is desirable that the clear toner be primarily transferred onto the intermediate transfer belt 8 first. Accordingly, as illustrated in FIGS. 1 and 16A, the process cartridge 6S (developing device 5S) for special color is disposed at the extreme upstream position in the rotation direction of the intermediate transfer belt 8. On the other hand, white toner as the special color toner is often used for forming an image on a colored recording medium P that is not white, and it is desirable that the white toner be secondarily transferred in the lowermost layer on the recording medium P. Accordingly, the process cartridge 6S (developing device 5S) for special color is disposed at the extreme downstream position in the rotation direction of the intermediate transfer belt 8 as illustrated in FIG. 16B. With the rearrangement of the installation position of the process cartridge 6S (developing device 5S) for special color, the position of the process cartridge 6K (developing device 5K) for black is replaced with the position of the process cartridge 6S (developing device 5S).

Next, referring to FIG. 13, the configuration and operation of the toner supply device 90S for special color (and the toner supply device 90K for black) according to the second embodiment are described below.

In the present embodiment, the toner supply device 90S (and the toner supply device 90K for black) have substantially the same configuration as that of the toner supply device 90Y for yellow (and the toner supply devices 90M and 90C for magenta and cyan) described in FIG. 3, except that the color (type) of the toner to be used is different, the conveyance path branches in a first tube 95S and a second tube 96S (a first tube 95K and a second tube 96K), and the first tube 95S (95K) include a valve 97. Therefore, descriptions of common configuration and operation are appropriately omitted.

In addition, the toner supply device 90K for black has substantially the same configuration as that of the toner supply device 90S for special color, except that the color (type) of the toner to be used is different. Therefore, descriptions of the toner supply device 90K are appropriately omitted, and only the toner supply device 90S for special color is described.

Similarly to the toner supply devices 90Y, 90M, and 90C, the toner supply device 90S for special color (or the toner supply device 90K for black) supplies toner (developer) contained in the toner container 32S (32K) as the developer container to the sub-hopper 70S (70K) as the supply destination.

As illustrated in FIG. 13 (and FIGS. 17A to 17D), the toner supply device 90S (90K) includes the toner container mount 31 in which the toner container 32S is installed, a reservoir 81S including the cap receiver 91 and the like, the conveyance pump 60S , the sub-hopper 70S, the first tube 95S serving as a first conveyance path, the second tube 96S serving as a second conveyance path, the valve 97 (e.g., a pinch valve), a cover 141 for the second tube 96S, a filter 142 for the second tube 96S, a cover 143 for the first tube 95S as a first conveyance path opening and closing member, a filter 144 for the first tube 95S as a first conveyance path filter, and the like.

Figure 14A:
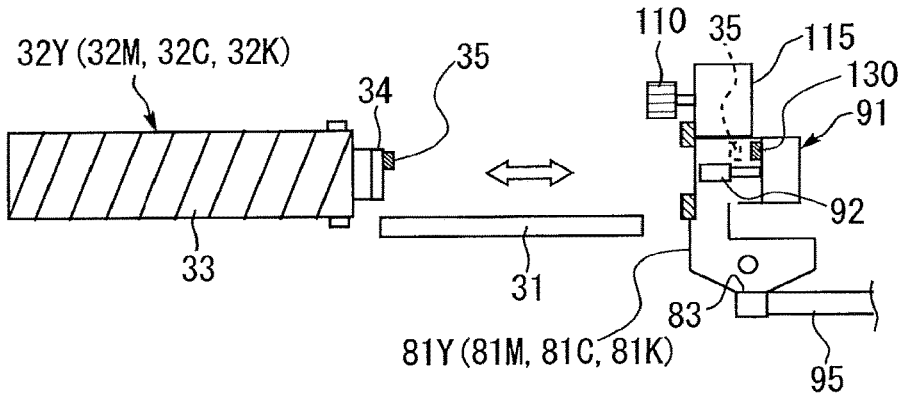
FIG. 14A is a schematic view illustrating an installation and removal of developer containers for colors and black in and from the developer supply device.
Figure 14B:
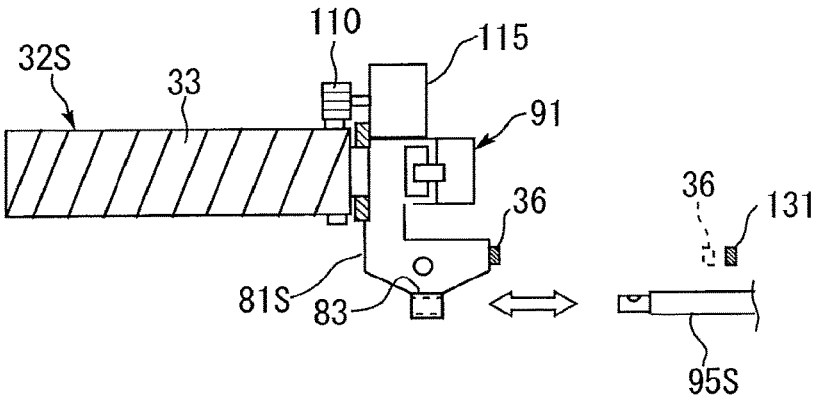
FIG. 14B is a schematic view illustrating an installation and removal of a developer container for special color in and from the developer supply device together with a reservoir.

Here, in the present embodiment, as illustrated in FIG. 14B, the toner container 32S and the reservoir 81S are removably installed as a single unit in the toner supply device 90S for special color. Specifically, the suction port 83 of the single unit of the toner container 32S and the reservoir 81S is detachably coupled to an upstream opening (the nozzle) of the tube 95S. Since the toner container 32S and the reservoir 81S together form the single unit, even when the toner container 32S for special color of a different type is replaced, this configuration alleviates color mixing in the reservoir 81S after replacement with special color toner before replacement.

On the other hand, as illustrated in FIG. 14A, similarly to the toner supply devices 90Y, 90M, and 90C for colors, the toner container 32K is detachably coupled to the reservoir 81K of the toner supply device 90K for black.

In any of the toner supply devices 90Y, 90M, 90C, 90K, and 90S, as described above, the tubes 95Y, 95M, 95C, 95K, and 95S (or the first tubes 95S and 95K and the second tubes 96S and 96K) are laid out in a space where various components are congested, and it is difficult to perform the replacement work. Therefore, in principle, the tubes 95Y, 95M, 95C, 95K, and 95S are secured to the apparatus body 100A so that users do not have to detach the tubes 95Y, 95M, 95C, 95K, and 95S from the apparatus body 100A.

Figure 15:
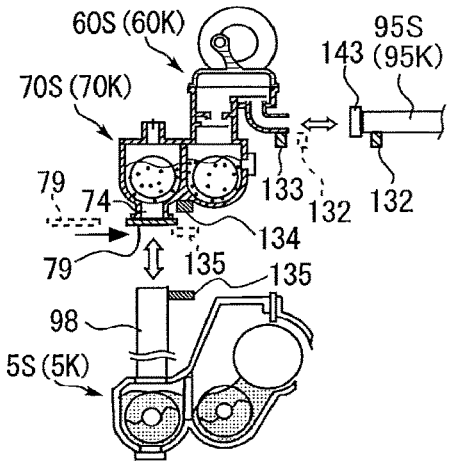
FIG. 15 is a schematic view illustrating an installation and removal of a developing device, the conveyance pump, and the sub-hopper in and from the developer supply device, respectively.

Further, in the second embodiment, as illustrated in FIG. 15, the conveyance pump 60S is detachably coupled to the toner supply device 90S together with the sub-hopper 70S (a supplied portion) as a unit. Further, the developing device 5S (process cartridge 6S) coupled to the conveyance pipe 98 is detachably coupled to the unit including the conveyance pump 60S and the sub-hopper 70S. When the toner container 32S (and the reservoir 81S) for special color is replaced with that of the different type, the conveyance pump 60S, the sub-hopper 70S, and the developing device 5S for special color are replaced with those of the different type corresponding to the replaced toner container 32S (and the reservoir 81S) as illustrated in FIG. 15. These configurations alleviate color mixing in the developing device 5S or the sub-hopper 70S for special color after replacement with the special color toner before replacement.

In the second embodiment, as illustrated in FIG. 15, a shutter 79 for opening and closing the discharge port 74 is provided in the unit including the conveyance pump 60S and the sub-hopper 70S. The shutter 79 is opened and closed in conjunction with the installment and removal operation of the developing device 5S. Thus, the shutter 79 prevents the toner leakage from the discharge port 74 of the sub-hopper 70 even when the developing device 5S is removed from the unit including the conveyance pump 60S and the sub-hopper 70S.

Further, in the toner supply device 90K for black according to the second embodiment, similarly to the toner supply device 90S for special color, the unit including the conveyance pump 60K and the sub-hopper 70K, and the developing device 5K are separately installed and removed, respectively as illustrated in FIG. 15.

Referring to FIG. 13, toner (developer) is conveyed through the first tube 95S as the first conveyance path coupled to the conveyance pump 60S. The first tube 95S functions similar to the tube 95Y of the toner supply device 90Y for yellow. The conveyance pump 60S is detachably coupled to downstream opening 95*a* of the first tube 95S. Further, the reservoir 81S is detachably coupled to upstream opening of the first tube 95S. The reservoir 81S stores toner discharged from the toner container 32S. The first tube 95S is formed of a flexible material with low affinity for toner, similar to the tube 95Y of the toner supply device 90Y for yellow.

The valve 97 is disposed in the middle of the conveyance path of the first tube 95S and opens and closes the conveyance path.

Specifically, when the valve 97 is off, the first tube 95S (first conveyance path) is opened, and toner and air can flow between the upstream side and the downstream side of the first tube 95S from the valve 97. On the other hand, when the valve 97 is on, the first tube 95S (the first conveyance path) is closed, and the flow of toner and air between the upstream side and the downstream side is blocked.

In particular, in the second embodiment, the pinch valve is used as the valve 97, so that trouble that the toner enters the valve 97 and the valve function deteriorates is less likely to occur.

Further, in the second embodiment, the controller 120 can control turning on and off of the valve 97 and detect on-off state. Specifically, users (or service engineers) operate the control panel mounted on an exterior part of the apparatus body 100A to change the valve 97 from the off state to the on state, or from the on state to the off state.

The second tube 96S as the second conveyance path branches from the first tube 95S at a downstream position from the valve 97. Specifically, the conveyance path is formed of one tube (the first tube 95S) from the reservoir 81S to a branch and is formed of the two tubes 95S and 96S branching from the branch. Particularly, in the second embodiment, the branch at which the two tubes 95S and 96S branch is disposed near the valve 97. The second tube 96S is formed of a flexible material with low affinity for toner, similarly to the first tube 95S.

The cover 141 for the second tube 96S opens and closes a tip opening 96*a* of the second tube 96S (see also FIGS. 17A to 17D). In the second embodiment, the cover 141 can be manually opened and closed the tip opening 96*a*.

The filter 142 for the second tube 96S is installed so as to cover the tip opening 96a of the second tube 96S (see also FIGS. 17A to 17D). Independently of the cover 141 for the second tube 96S, the filter 142 for the second tube 96S can be manually opened and closed the tip opening 96*a* of the second tube 96S. The filter 142 for the second tube 96S captures toner (developer) and allow air to pass therethrough, and a known toner filter can be used.

On the other hand, the cover 143 for the first tube 95S opens and closes the downstream opening 95*a* of the first tube 95S (see FIGS. 17A to 17D). In the second embodiment, the cover 143 for the first tube 95S can manually open and close the downstream opening 95*a*.

The filter 144 for the first tube 95S is installed so as to cover the downstream opening 95*a* of the first tube 95S (see FIGS. 17A to 17D). Independently of the cover 143, the filter 144 for the first tube 95S can manually open and close the downstream opening 95*a* of the first tube 95S. The filter 144 for the first tube captures toner (developer) and allow air to pass therethrough, and a known toner filter can be used.

Figure 17A:
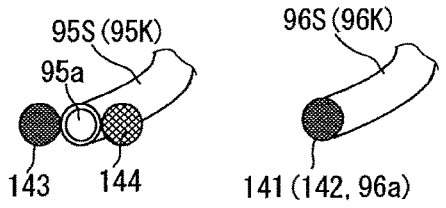
FIG. 17A is a schematic view of a first tube and a second tube in a supply mode.

Here, in the second embodiment, when the toner supply device 90S for special color supplies toner (developer) to the sub-hopper 70S (the supplied portion), that is a toner supply mode, the conveyance pump 60S (the motor 67) operates while the first tube 95S (first conveyance path) is opened by the valve 97, and the cover 141 for the second tube 96S closes the tip opening 95*a* for the second tube 96S as illustrated in FIG. 17A. The toner supply device 90K for black in the toner supply mode also operates similarly as described above.

In the case of the toner supply mode, the image forming process described with reference to FIGS. 1 and 2 is performed with the arrangement of the developing devices 5Y, 5M, 5C, 5K, and 5S; the sub-hoppers 70Y, 70M, 70C, 70K, and 70S; and the conveyance pumps 60Y, 60M, 60C, 60K, and 60S in this order as illustrated in FIGS. 1 and 16A, as described above, for example, the clear toner is used as a special color toner. That is, the toner supply mode is performed in conjunction with an operation for performing a normal print instruction by users as a control in a normal image forming process.

At that time, as illustrated in FIG. 17A, since the tip opening 96*a* of the second tube 96S is closed by the cover 141 for second tube 96S, the second tube 96S does not interfere with toner conveyance in the first tube 95S. Further, since the downstream opening 95*a* of the first tube 95S is coupled to the conveyance pump 60S while being open so that either the cover 143 or the filter 144 for the first tube 95S does not interfere with the downstream opening 95*a*, the cover 143 and the filter 144 for the first tube 95S do not interfere with toner conveyance.

Figure 17B:
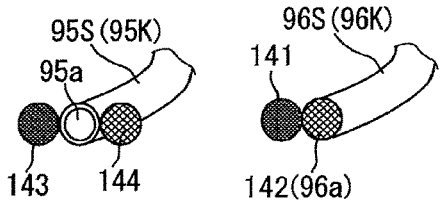
FIG. 17B is a schematic view of the first tube and the second tube in a cleaning mode.

In the second embodiment, when a cleaning mode for cleaning the interior of the first tube 95S is executed, the valve 97 closes the first tube 95S (first conveyance path), and the conveyance pump 60S operates in a state in which the tip opening 96*a* of the second tube 96S is opened by the cover 141 for second tube 96S as illustrated in FIG. 17B. At that time, the filter 142 for the second tube 96S covers the tip opening 96*a* of the second tube 96S (i.e., a closed state). In addition, the downstream opening 95*a* of the first tube 95S is coupled to the conveyance pump 60S.

In this way, since the filter 142 for the second tube 96S covers the tip opening 96*a* of the second tube 96S and the valve 97 is in the closed state, the conveyance pump 60S sucks toner remaining in the conveyance path together with air from tip opening 96*a* of the second tube 96S to the downstream opening 95*a* via the branch (and the valve 97) without leakage of toner from the tip opening 96*a*, thereby cleaning the conveyance path preferably. Therefore, after the cleaning mode, there is no leakage of toner from the first tube 95S even if the conveyance pump 60S is removed from the first tube 95S.

In the second embodiment, although the filter 142, which can be opened and closed, covers the tip opening 96*a* of the second tube 96S in the cleaning mode, alternatively, the filter 142 for the second tube 96S can be omitted if the leakage of toner can be ignored because air is sucked from the tip opening 96*a* of the second tube 96S and toner is hardly leaked. This explanation described above also applies to the filter 144 for the first tube 95S in the second cleaning mode to be described later.

Further, when the cleaning mode is executed as described above, the conveyance path from the upstream opening of the first tube 95S to the valve 97 is not cleaned. However, the valve 97 (and the branch) is disposed in the extreme upstream portion of the conveyance path of the first tube 95S or in the vicinity thereof, and toner remaining therein is minute. Therefore, there is no problem such as the above-described color mixing of toner.

The cleaning mode is executed when the toner container 32S (and the reservoir 81S) is replaced with a different type of toner container 32S (and a reservoir 81S) for special color as described above, and also, a trouble of the first tube 95S that the ability to convey toner of the tube 95S is deteriorated due to clogging with the toner occurs.

In the former case, the cleaning mode can be executed either before or after the toner container 32S (and the reservoir 81S) is replaced, before the conveyance pump 60S, the sub-hopper 70S, and the developing device 5S are replaced. In such a case, the first tube 95S can be sufficiently and efficiently cleaned in a short time without sucking up the toner remaining in the toner container 32S and the reservoir 81S.

Further, in the latter case, the first tube 95S can be sufficiently and efficiently cleaned in a short time without sucking up the toner remaining in the toner container 32S and the reservoir 81S and without removing the toner container 32S (and the reservoir 81S) from the apparatus body 100A.

As users or service engineers operate the control panel mounted on the exterior part of the apparatus body 100A, the controller 120 executes the cleaning mode.

At that time, even if the execution of the cleaning mode is selected by the control panel, when the controller 120 does not detect closing of the valve 97, or sensors do not detect the state of FIG. 17B, the controller determined that the cleaning mode is not executed normally, and the cleaning mode is not executed. The sensors are, for example, push type sensors to detect opening and closing states of the covers 141 and 143 or the filters 142 and 144.

Such control is similarly executed in the second cleaning mode to be described later.

Here, in the second embodiment, the tip opening 96*a* of the second tube 96S can be coupled to a conveyance pump different from the conveyance pump 60S for special color illustrated in FIGS. 1 and 16A. The different conveyance pump supplies toner to a sub-hopper (a different supplied portion) different from the sub-hopper 70S (the supplied portion) for special color illustrated in FIGS. 1 and 16A. Specifically, the second tube 96S is connectable to the conveyance pump 60K for black illustrated in FIG. 16A. However, in actuality, the second tube 96S is not coupled to the conveyance pump 60K for black, and as illustrated in FIG. 16B, the second tube 96S is coupled to the conveyance pump 60S for special color swapped for the conveyance pump 60K illustrated in FIG. 16A.

With this configuration, without changing the arrangement order (arrangement) of the toner containers 32Y, 32M, 32C, 32K, and 32S and the toner supply devices 90Y, 90M, 90C, 90K, and 90S, the image forming process can be performed with the arrangement of the developing devices 5K, 5Y, 5M, 5C, and 5S; the sub-hoppers 70K, 70Y, 70M, 70C, and 70S; and the conveyance pumps 60K, 60Y, 60M, 60C, and 60S in this order as illustrated in FIG. 16B. As described above, the case in which the image forming process is performed in such the arrangement order is, for example, a case in which white toner is used as special color toner.

Figure 17C:
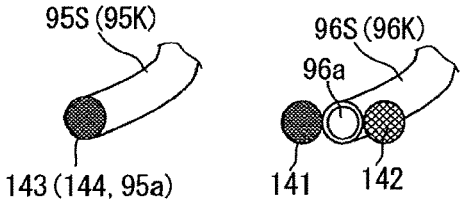
FIG. 17C is a schematic view of the first tube and the second tube in a second supply mode.

Specifically, after the above-described cleaning mode is executed, the first tube 95S is released from the conveyance pump 60S. Then, as illustrated in FIG. 17C, the cover 143 for the first tube 95S closes the downstream opening 95*a* of the first tube 95S, and the cover 141 for the second tube 96S opens the tip opening 96*a* of the second tube 96S. The opening 96*a* of the second tube 96S is coupled to the conveyance pump 60S for special color illustrated in FIG. 16B in a state in which the filter 142 for the second tube 96S opens the tip opening 96*a* of the second tube 96S. Subsequently, the valve 97 opens the first tube 95S (the first conveyance path), and a second supply mode is executed to supply toner to the sub-hopper 70S for special color (the different supplied portion) illustrated in FIG. 16B.

After the cleaning mode described above, the toner container 32S (and the reservoir 81S) for special color is replaced with a desired type, and the conveyance pump 60S, the sub-hopper 70S, and the developing device 5S for special color are similarly replaced with a desired type. Subsequently, the second supply mode is executed after an initial supply mode to be described later, in conjunction with an operation for performing a usual print command by users as a control of normal image forming process in a state illustrated in FIG. 16B.

When the cleaning mode is executed in order to replace the toner container 32S (and the reservoir 81S) for special color with that of the different type, if the controller 120 does not detect that the toner container 32S (and the reservoir 81S) is replaced with that of the desired type and that the conveyance pump 60S, the sub-hopper 70S, and the developing device 5S for special color are replaced with those of the desired type corresponding to the replaced toner container 32S (and the reservoir 81S), the second supply mode and the initial supply mode to be described later are not executed, and those information are displayed on a display of the image forming apparatus 100.

Specifically, as illustrated in FIG. 14B, the single unit of the toner container 32S and the reservoir 81S includes an electronic substrate 36 storing information on the type of toner and the like. In the apparatus body 100A, when the single unit of the toner container 32S and the reservoir 81S is normally set, an antenna substrate 131 reads the information stored in the electronic substrate 36 and sends the information to the controller 120.

Further, as illustrated in FIG. 14A, the toner containers 32Y, 32M, 32C, and 32K for colors and black include electronic substrates 35 storing information on the type of toner and the like. In the cap receiver 91 (apparatus body 100A), when the toner containers 32Y, 32M, 32C, and 32K are normally set, antenna substrates 130 read the information stored in the electronic substrates 35 and send the information to the controller 120.

With these configurations, the controller 120 can detect a state in which the toner container 32S (and the reservoir 81S) for special color is normally replaced with a desired type.

As illustrated in FIG. 15, the unit including the conveyance pump 60S and sub-hopper 70S includes an electronic substrate 133 storing information on the type of toner and the like. Further, in the apparatus body 100A, when the unit including the conveyance pump 60S and the sub-hopper 70S is normally set, an antenna substrate 132 reads the information stored in the electronic substrate 133 and sends to the controller 120.

Further, the developing device 5S includes an electronic substrate 135 storing information on the type of toner and the like. Further, the sub-hopper 70S of the toner supply device 90 includes an antenna substrate 134 for reading information stored in the electronic substrate 135 and sending the information to the controller 120 when the developing device 5S is normally set.

With these configurations, the controller 120 can detect a state in which the conveyance pump 60S, the sub-hopper 70S, and the developing device 5S for special color are normally replaced with desired types.

Such control is similarly executed after the second cleaning mode to be described later.

Figure 17D:
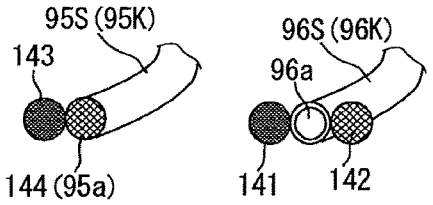
FIG. 17D is a schematic view of the first tube and the second tube in a second cleaning mode.

In the second embodiment, when the second cleaning mode for cleaning the interior of the second tube 96S is executed, the valve 97 closes the first tube 95S (first conveyance path), and the conveyance pump 60S (the replaced conveyance pump) coupled to the second tube 96S at a position illustrated in FIG. 16B operates in a state in which the cover 143 for first tube 95S opens the downstream opening 95*a* of the first tube 95S and the filter 144 of the first tube 95S closes (covers) the downstream opening 95*a* of the first tube 95S as illustrated in FIG. 17D.

In this way, since the filter 144 for the first tube 95S covers the downstream opening 95*a* of the first tube 96S and the valve 97 is in the closed state, the conveyance pump 60S sucks toner remaining in the conveyance path together with air from the downstream opening 95*a* to the tip opening 96*a* of the second tube 96S via the branch (and the valve 97) without leakage of toner from the tip opening 96*a*, thereby cleaning the conveyance path preferably, similarly to the cleaning mode.

After the second cleaning mode described above, the toner container 32S (and the reservoir 81S) for special color is replaced with a desired type, and the conveyance pump 60S, the sub-hopper 70S, and the developing device 5S for special color are similarly replaced with a desired type. Subsequently, the cleaning mode described with reference to FIG. 17A is executed again after the initial supply mode to be described later.

Here, in the second embodiment, when the cleaning mode is executed, the toner (developer) is discharged from the sub-hopper 70S (the supplied portion). Specifically, the controller 120 controls the supply motor 121 to rotate the first conveyance screw 71 and the second conveyance screw 72 of the sub-hopper 70S, and toner is discharged from the sub-hopper 70S to the developing device 5S in the cleaning mode.

As a result, in the cleaning mode, if toner remaining in the first tube 95S flows into the sub-hopper 70S at a burst, the toner does not eject from the sub-hopper 70S.

Here, in the second embodiment, when the cleaning mode is executed and toner is discharged from the sub-hopper 70S to the developing device 5S, the developing device 5S discharges the toner. Specifically, in the cleaning mode, the image forming process (the primary transfer process is not performed) substantially similar to that described above is performed, and the toner image (for example, a black solid band pattern) is formed on the photoconductor 1 to consume the toner in the developing device 5S.

As a result, in the cleaning mode, if the toner remaining in the first tube 95S flows into the developing device 5S via the sub-hopper 70S, the toner does not eject from the developing device 5S.

Such control is similarly executed in the second cleaning mode described above.

Further, in the second embodiment, when the cleaning mode is executed, the conveyance pump 60S (the motor 67) is driven under predetermined conditions after the hopper sensor 76 detects shortage of the toner in the sub-hopper 70S. Then, the conveyance pump 60S (the motor 67) is stopped, and the cleaning mode is terminated.

Specifically, in the second embodiment, if the hopper sensor 76 detects shortage of the toner after the cleaning mode, the conveyance pump 60S (the motor 67) is not immediately stopped. The conveyance pump 60S (the motor 67) is intermittently driven for predetermined cycles at regular intervals. Then, the rotation speed of the conveyance pump 60S (the motor 67) is increased to increase the ability to convey toner and is continuously driven for a predetermined time.

With such control, since the conveyance pump 60S (the motor 67) is driven after the hopper sensor 76 detects shortage of toner in the sub-hopper 70S, the toner remaining in the first tube 95S is removed reliably.

Such control is similarly executed in the second cleaning mode described above.

Further, in the second embodiment, after the cleaning mode is completed, the initial supply mode is executed in which toner (developer) is supplied from the toner container 32S (the developer container) to the sub-hopper 70S (the supplied portion) in a state in which the valve 97 opens the first tube 95S (the first conveyance path), until the hopper sensor 76 does not detect the shortage of toner.

Specifically, the initial supply mode is executed immediately after the completion of the cleaning mode and before the supply mode (normal image forming process) is performed. In the initial supply mode, the conveyance pump 60S (the motor 67) operates while the supply motor 121 rotates the first conveyance screw 71 and the second conveyance screw 72 to circulate toner in the sub-hopper 70S until the hopper sensor 76 detects that the toner contained in the sub-hopper 70S exceeds predetermined amount of toner. At that time, in the initial supply mode, similarly to the supply mode, the first tube 95S is coupled to the conveyance pump 60S, and the cover 141 for the second tube 96S closes the second tube 96S as illustrated in FIG. 17A.

Since the supply mode (normal image forming process) is executed after the initial supply mode, toner supplied to the developing device 5Y is not insufficient, thereby performing image formations preferably.

Such control is similarly executed after the second cleaning mode described above.

In the rearrangement operation of the developing devices 5Y, 5M, 5C, 5K, and 5S, the sub-hopper 70Y, 70M, 70C, 70K, and 70S, and conveyance pumps 60Y, 60M, 60C, 60K, and 60S from the state A illustrated in FIG. 16A to the state B illustrated in FIG. 16B (or from the state B illustrated in FIG. 16B to the state A illustrated in FIG. 16A), the control and operation of the toner supply device 90K for black are executed similarly to those of the toner supply device 90S for special color.

As described above, in the image forming apparatus 100 according to the second embodiment, similarly to the first embodiment described above, the arrangement of the plurality of developing devices 5Y, 5M 5C, 5K, and 5S in the rotation direction of the intermediate transfer belt 8 (the intermediate transferor) is changed while satisfying the following. The arrangement of the plurality of toner containers 32Y, 32M, 32C, 32K, and 32S (developer containers) is not changed. The layout of the plurality of tubes 95Y, 95M, 95C, 95K, and 95S is changed so that the connections between the supply source and the supply destination of the plurality of tubes 95Y, 95M, 95C, 95K, and 95S (conveyance paths) is not changed.

Accordingly, the rearrangement of the plurality of developing devices 5Y, 5M, 5C, 5K, and 5S can simply be performed to change the order of toner colors deposited on the surface of the intermediate transfer belt 8.

In particular, in the toner supply device 90S according to the second embodiment, the conveyance pump 60S is detachably coupled to the downstream opening 95*a* of the first tube 95S (first conveyance path). The valve 97 is disposed in the middle of the first tube 95S, and the second tube 96S (second conveyance path) branches from the first tube 95S at a position downstream from the valve 97. In the supply mode, the conveyance pump 60S operates while the valve 97 is open and the cover 141 closes the tip opening 96*a* of the second tube 96S. On the other hand, in the cleaning mode, the conveyance pump 60S operates while the valve 97 is close and the cover 141 opens the tip opening 96*a* of the second tube 96S With such a configuration, the first tube 95S can be sufficiently and efficiently cleaned in a short time without removing the toner container 32S (the developer container) from the toner supply device 90S.

Although the description of the second embodiment concerns the multicolor image forming apparatus 100 that includes the multiple process cartridges 6 (the image forming units), the aspects of this specification can adapt to a single-color or monochrome image forming apparatus including a single image forming unit. In that case, the cleaning mode is executed when the interior of the first tube 95 is simply cleaned without replacing a toner container and a developing device. Alternatively, the cleaning mode is executed when the interior of the first tube 95 is cleaned for replacing a toner container and a developing device. The second tube 96 is not coupled to a different conveyance pump.

Even in such a case, the interior of the tube 95 can be sufficiently and efficiently cleaned in a short time without removing the toner container 32 (developer container).

Although the second embodiment concerns the toner supply devices 90S and 90K for special color and black in the second embodiment, the present disclosure can be applied to the toner supply devices 90Y, 90M, and 90C for colors.

In the second embodiment, the pinch valve is used as the valve 97. However, the valve 97 is not limited to the pinch valve, as long as the valve 97 can open and close the first tubes 95S and 95K (first transport path).

In such configurations, effects similar to those described above are also attained.

In the embodiments described above, the photoconductor drum 1Y serving as the image bearer, the charger 4Y, the developing device 5Y, and the cleaner 2Y are united as the process cartridge 6Y. However, the present disclosure is not limited to the embodiments described above, and applied to the apparatus body 100A in which the developing device 5Y is removably installed as a single unit.

It is to be noted that the term "process cartridge" used in this specification means a unit including an image bearer and at least one of a charging device to charge the image bearer, a developing device to develop latent images on the image bearer, and a cleaner to clean the image bearer united together and is designed to be removably installed together in the apparatus body of the image forming apparatus.

In the above-described embodiments, the supplied portion (the supply destination) coupled to the conveyance pump 60S is the sub-hopper 70S coupled to the developing device 5S. On the other hand, the supplied portion (the supply destination) coupled to the conveyance pump 60S can be the developing device 5Y. That is, toner can be directly supplied from the conveyance pump 60S to the developing device 5S without the sub-hopper 70S.

Additionally, although the toner container 32S including the substantially cylindrical, rotatable container body is removably installed in the toner supply device 90S in the embodiments described above, the shape of the toner containers 32S installed in the toner supply device 90S are not limited thereto. This disclosure can adapt to toner supply devices, in which, for example, a box-shaped toner container is installed.

In such configurations, effects similar to those described above are attained.

It is to be noted that it is clear that the present disclosure is not limited to the above-described embodiments and modifications to and variations of the above-described teachings are possible within the technical principles of the present disclosure. The number, position, shape of the components of the image forming apparatus described above are not limited to those described above. For example, elements and/or features of different illustrative embodiments may be combined with each other and/or substituted for each other within the scope of the present disclosure.

What is claimed is:

1. An image forming apparatus comprising:

an intermediate transferor to rotate in a predetermined rotation direction;

a plurality of image bearers disposed along the intermediate transferor in the predetermined rotation direction of the intermediate transferor to bear latent images;

a plurality of developing devices to develop the latent images on the plurality of image bearers;

a plurality of developer containers to contain developers; and a plurality of conveyance paths each corresponding to a respective one of the plurality of developing devices and a respective one of the plurality of developer containers, to supply the developers contained in the plurality of developer containers to the plurality of developing devices respectively, an arrangement of the plurality of developing devices in the predetermined rotation direction configured to be changed without changing an arrangement of the plurality of developer containers, and a layout of the plurality of conveyance paths configured to be changed without changing connections between a supply source and a supply destination of the plurality of conveyance paths.

2. The image forming apparatus according to claim 1, wherein the plurality of developing devices each forms one of a plurality of process cartridges together with a respective one of the plurality of image bearers, and wherein an arrangement of the plurality of process cartridges in the predetermined rotation direction is configured to be changed without changing the arrangement of the plurality of developer containers.

3. The image forming apparatus according to claim 2, further comprising:

a plurality of conveyance pumps each detachably coupled to a downstream opening of a respective one of the plurality of conveyance paths, a plurality of sub-hoppers each coupled to a respective one of the plurality of conveyance pumps and a respective one of the plurality of developing devices, wherein the arrangement of the plurality of process cartridges, an arrangement of the plurality of conveyance pumps, and an arrangement of the plurality of sub-hoppers in the predetermined rotation direction are configured to be changed without changing connections among the plurality of process cartridges, the plurality of conveyance pumps, and the plurality of sub-hoppers, and wherein the layout of the plurality of conveyance paths is configured to be changed without changing connections between the plurality of conveyance paths and the plurality of conveyance pumps.

4. The image forming apparatus according to claim 1, wherein two developing devices of the plurality of developing devices located at an extreme upstream position and at an extreme downstream position in the predetermined rotation direction are configured to be swapped without changing the arrangement of the plurality of developer containers, and a layout of two conveyance paths of the plurality of conveyance paths corresponding to the two developing devices is configured to be changed, wherein one of the two developing devices is for a special color, and wherein a length of each of the two conveyance paths is set in accordance with a farther one of the two developing devices from corresponding two of the plurality of developer containers.

5. The image forming apparatus according to claim 1, wherein the plurality of developing devices includes:

a developing device for black;

at least one developing device for a color other than black; and a developing device for a special color, wherein, without changing the arrangement of the plurality of developer containers, positions of the developing device for black and the at least one developing device for the color other than black are configured to be shifted one by one in the predetermined rotation direction without changing an order of the developing device for black and the at least one developing device for the color other than black in the predetermined rotation direction, to shift the developing device for the special color to an extreme upstream position or an extreme downstream position, and the layout of all of the plurality of conveyance paths are configured to be changed.

6. The image forming apparatus according to claim 5, wherein the plurality of conveyance paths includes:

a conveyance path for black;

at least one conveyance path for the color other than black; and a conveyance path for the special color, wherein the conveyance path for black corresponding to the developing device for black and the at least one conveyance path for the color other than black corresponding to the at least one developing device for the color other than black have lengths for a state in which the positions of the developing device for black and the at least one developing device for the color other than black are configured to be shifted one by one in the predetermined rotation direction.

7. The image forming apparatus according to claim 1, further comprising a tube housing, wherein the plurality of conveyance paths is a plurality of tubes, and wherein the tube housing is configured to accommodate at least one of the plurality of tubes without the at least one of the plurality of tubes buckling.

8. The image forming apparatus according to claim 7, wherein the tube housing is a cylindrical member including a core shaft inside the cylindrical member, and wherein the at least one of the plurality of tubes winds once around the core shaft to change a size of winding of the at least one of the plurality of tubes.

9. The image forming apparatus according to claim 1, further comprising a reinforcing member, wherein the plurality of conveyance paths is a plurality of tubes, and wherein the reinforcing member extends around at least one of the plurality of tubes to reinforce the at least one of the plurality of tubes without the at least one of the plurality of tubes buckling.

10. The image forming apparatus according to claim 9, wherein a downstream opening or an upstream opening of the at least one of the plurality of tubes is detachably coupled to a connection portion of the supply source or the supply destination, and wherein the reinforcing member includes an engaged portion to engage an engagement portion of the connection portion of the supply source or the supply destination.

11. The image forming apparatus according to claim 10, wherein the reinforcing member and the at least one of the plurality of tubes satisfies D0>D2>D1, where D0 is an inner diameter of the reinforcing member, D1 is an outer diameter of the at least one of the plurality of tubes, and D2 is an outer diameter of the at least one of the plurality of tubes in a coupled state with the connection portion.

12. The image forming apparatus according to claim 1, further comprising a rotary portion, wherein the plurality of conveyance paths is a plurality of tubes, and wherein the rotary portion is attached to at least one of the plurality of tubes to rotate at least a part of the at least one of the plurality of tubes to prevent the at least one of the plurality of tubes from twisting.

13. The image forming apparatus according to claim 1, further comprising:

a plurality of conveyance pumps each detachably coupled to a downstream opening of a respective one of the plurality of conveyance paths, a valve disposed in a middle of at least one of the plurality of conveyance paths to open and close the at least one of the plurality of conveyance paths;

a second conveyance path to branch from the at least one of the plurality of conveyance paths at a position downstream from the valve; and a cover to open and close a tip opening of the second conveyance path, wherein when a supply mode is executed to supply developer to a supplied portion as the supply destination, one of the plurality of conveyance pumps corresponding to the at least one of the plurality of conveyance paths operates in a state in which the valve opens the at least one of the plurality of conveyance paths and the cover closes the tip opening of the second conveyance path, and wherein when a cleaning mode is executed to clean an interior of the at least one of the plurality of conveyance paths and the second conveyance path, the one of the plurality of conveyance pumps corresponding to the at least one of the plurality of conveyance paths operates in a state in which the valve closes the at least one of the plurality of conveyance paths and the cover opens the tip opening of the second conveyance path.

* * * * *